US009538887B2

(12) United States Patent
Ito et al.

(10) Patent No.: US 9,538,887 B2
(45) Date of Patent: Jan. 10, 2017

(54) READY-TO-ASSEMBLE TOILET

(71) Applicant: DAIKI CO., LTD., Tokyo (JP)

(72) Inventors: Hiroshi Ito, Tokyo (JP); Junji Yoshinaga, Tokyo (JP)

(73) Assignee: DAIKI CO., LTD., Tokyo (JP)

( * ) Notice: Subject to any disclaimer, the term of this patent is extended or adjusted under 35 U.S.C. 154(b) by 160 days.

(21) Appl. No.: 14/567,701

(22) Filed: Dec. 11, 2014

(65) Prior Publication Data

US 2016/0066753 A1 Mar. 10, 2016

(30) Foreign Application Priority Data

Sep. 8, 2014 (JP) ..... 2014-182130

(51) Int. Cl.
*A47K 11/04* (2006.01)
*A47K 11/02* (2006.01)
*A47K 11/00* (2006.01)

(52) U.S. Cl.
CPC ..... *A47K 11/02* (2013.01); *A47K 11/00* (2013.01)

(58) Field of Classification Search
CPC ..... A47K 11/06
USPC ..... 4/449–486
See application file for complete search history.

(56) References Cited

U.S. PATENT DOCUMENTS 2,631,699 A * 3/1953 Schultz ..... A47D 1/02 190/8
4,199,826 A * 4/1980 Devereux ..... A47K 11/02 190/111
4,621,380 A * 11/1986 McGill ..... A47K 11/02 4/455
4,710,989 A * 12/1987 Grenthe ..... A47K 11/04 4/449
5,040,249 A * 8/1991 Diaz ..... A47C 5/005 4/460
5,048,130 A * 9/1991 Brotman ..... A47K 11/04 4/476
5,524,301 A * 6/1996 McGuire ..... A47K 11/02 4/449
5,682,623 A * 11/1997 Fenoglio ..... A47K 11/02 297/440.12
5,732,418 A * 3/1998 Sekitou ..... A47K 11/02 229/125.17
8,499,371 B1 * 8/2013 Becker ..... B63B 29/14 4/476
2006/0031982 A1 * 2/2006 Pittman ..... A47K 11/00 4/483

(Continued)

FOREIGN PATENT DOCUMENTS

JP A-2008-104558 5/2008
JP 2009000425 A * 1/2009

*Primary Examiner* — Lori Baker
(74) *Attorney, Agent, or Firm* — Oliff PLC

(57) ABSTRACT

A box-shaped ready-to-assemble toilet is made of corrugated board or cardboard. The ready-to-assemble toilet includes first to fourth sidewall portions and a bottom portion. Each of the first to fourth sidewall portions includes an outer sidewall, an inner sidewall and a horizontal wall. The horizontal walls of the first and second sidewall portions overlap each other. The horizontal walls of the second and third sidewall portions overlap each other. The horizontal walls of the third and fourth sidewall portions overlap each other. The horizontal walls of the fourth and first sidewall portions overlap each other.

22 Claims, 20 Drawing Sheets

(56) References Cited

U.S. PATENT DOCUMENTS

| | | | | |
|---|---|---|---|---|
| 2009/0038066 | A1* | 2/2009 | Kallmann | A47K 11/02 4/479 |
| 2009/0165199 | A1* | 7/2009 | Heumann | A47K 11/02 4/483 |
| 2010/0180370 | A1* | 7/2010 | Helewa | A47K 11/04 4/484 |
| 2010/0269249 | A1* | 10/2010 | Wharton | A47K 11/02 4/479 |
| 2012/0192343 | A1* | 8/2012 | Richardson | A47K 11/02 4/449 |
| 2013/0139311 | A1* | 6/2013 | Shaw | A47K 11/02 4/479 |
| 2013/0227776 | A1* | 9/2013 | Ito | A47K 11/02 4/479 |
| 2015/0289732 | A1* | 10/2015 | Ito | A47K 11/02 4/479 |
| 2016/0045085 | A1* | 2/2016 | Zawrotniak | A47K 11/06 4/484 |

* cited by examiner

READY-TO-ASSEMBLE TOILET

CROSS REFERENCE TO RELATED APPLICATION

This application is based on Japanese patent application No. 2014-182130 filed Sep. 8, 2014, the content of which is hereby incorporated by reference.

BACKGROUND OF THE INVENTION

1. Field of the Invention

The present invention relates to a ready-to-assemble toilet made of paper.

2. Description of the Related Art

A conventional ready-to-assemble toilet is disclosed in, for example, JP 2008-104558A. The ready-to-assemble toilet disclosed in this document includes an outer box having a bottom portion and four sidewall portions, and an inner box having four sidewall portions. The outer box and the inner box are both made of corrugated board. The inner box is arranged in the outer box such that the inner box is spaced apart from the sidewall portions of the outer box. The inner box is internally provided with a plastic bag for accommodating excrement. A toilet seat portion is provided on the top of the outer box.

In the above-described ready-to-assemble toilet, each sidewall is constituted by a sidewall portion of the outer box and a sidewall portion of the inner box. With the double-wall sidewalls, the strength of the toilet can be enhanced to a certain degree. However, there is still room for improvement in such a ready-to-assemble toilet in terms of strength.

SUMMARY OF THE INVENTION

The present invention has been made in view of the above-described circumstances, and it is an object of the present invention to provide a ready-to-assemble toilet having excellent strength.

A ready-to-assemble toilet according to the present invention is a ready-to-assemble toilet made of corrugated board or cardboard and being box-shaped, comprising: a first sidewall portion, a second sidewall portion adjacent to the first sidewall portion, a third sidewall portion adjacent to the second sidewall portion, a fourth sidewall portion adjacent to the third sidewall portion, and a bottom portion, wherein each of the first to fourth sidewall portions includes an outer sidewall, an inner sidewall facing the outer sidewall, and a horizontal wall connecting an upper end of the outer sidewall and an upper end of the inner sidewall, the horizontal wall of the first sidewall portion and the horizontal wall of the second sidewall portion overlap each other, the horizontal wall of the second sidewall portion and the horizontal wall of the third sidewall portion overlap each other, the horizontal wall of the third sidewall portion and the horizontal wall of the fourth sidewall portion overlap each other, and the horizontal wall of the fourth sidewall portion and the horizontal wall of the first sidewall portion overlap each other.

In the ready-to-assemble toilet, each of the sidewall portions has a double-wall structure formed of the outer sidewall and the inner sidewall. Furthermore, each of the sidewall portions is provided with the horizontal wall that connects the outer sidewall and the inner sidewall. The horizontal wall of each of the sidewall portions is configured to overlap the horizontal wall of the adjacent sidewall portion. Accordingly, a structure where the sidewall portions support each other is implemented, and therefore the strength of the toilet can be remarkably enhanced.

According to the present invention, it is possible to implement a ready-to-assemble toilet having excellent strength.

DESCRIPTION OF THE PREFERRED EMBODIMENTS

Figure 1:
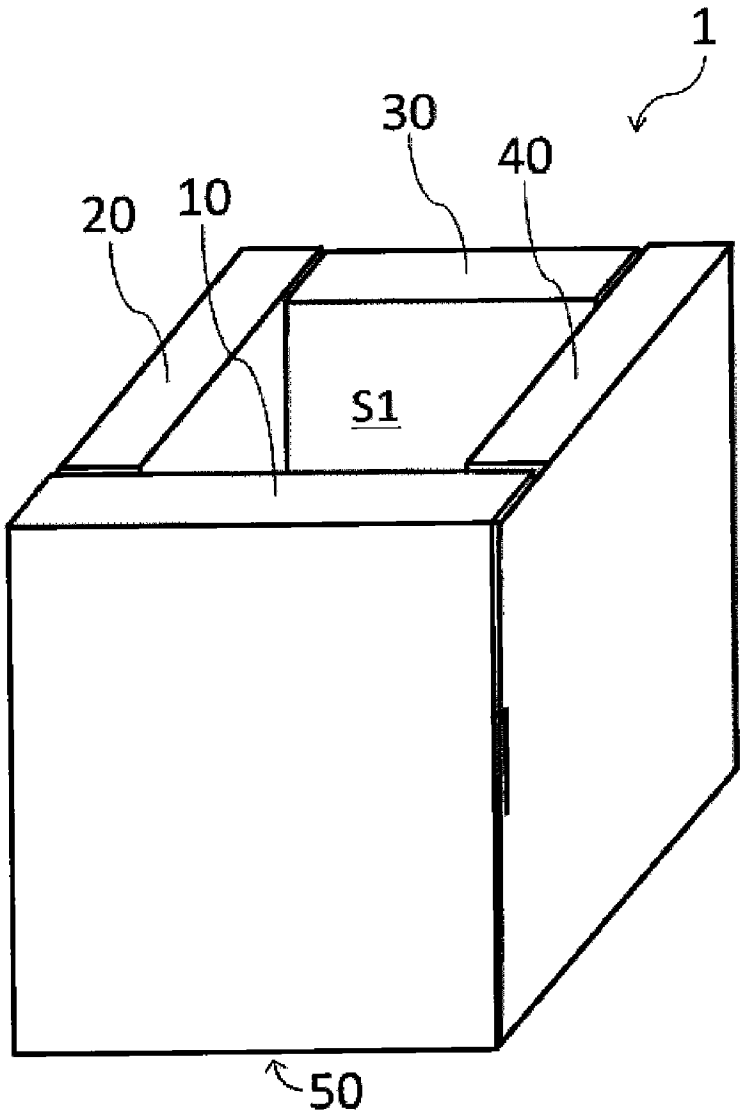
FIG. 1 is a perspective view of a ready-to-assemble toilet according to the first embodiment of the present invention.

Hereinafter, embodiments of the present invention will be described in detail with reference to the drawings. When referring to the drawings, the same elements are given the same reference numerals, and thus a duplicate description is omitted.

(First Embodiment)

Figure 2:
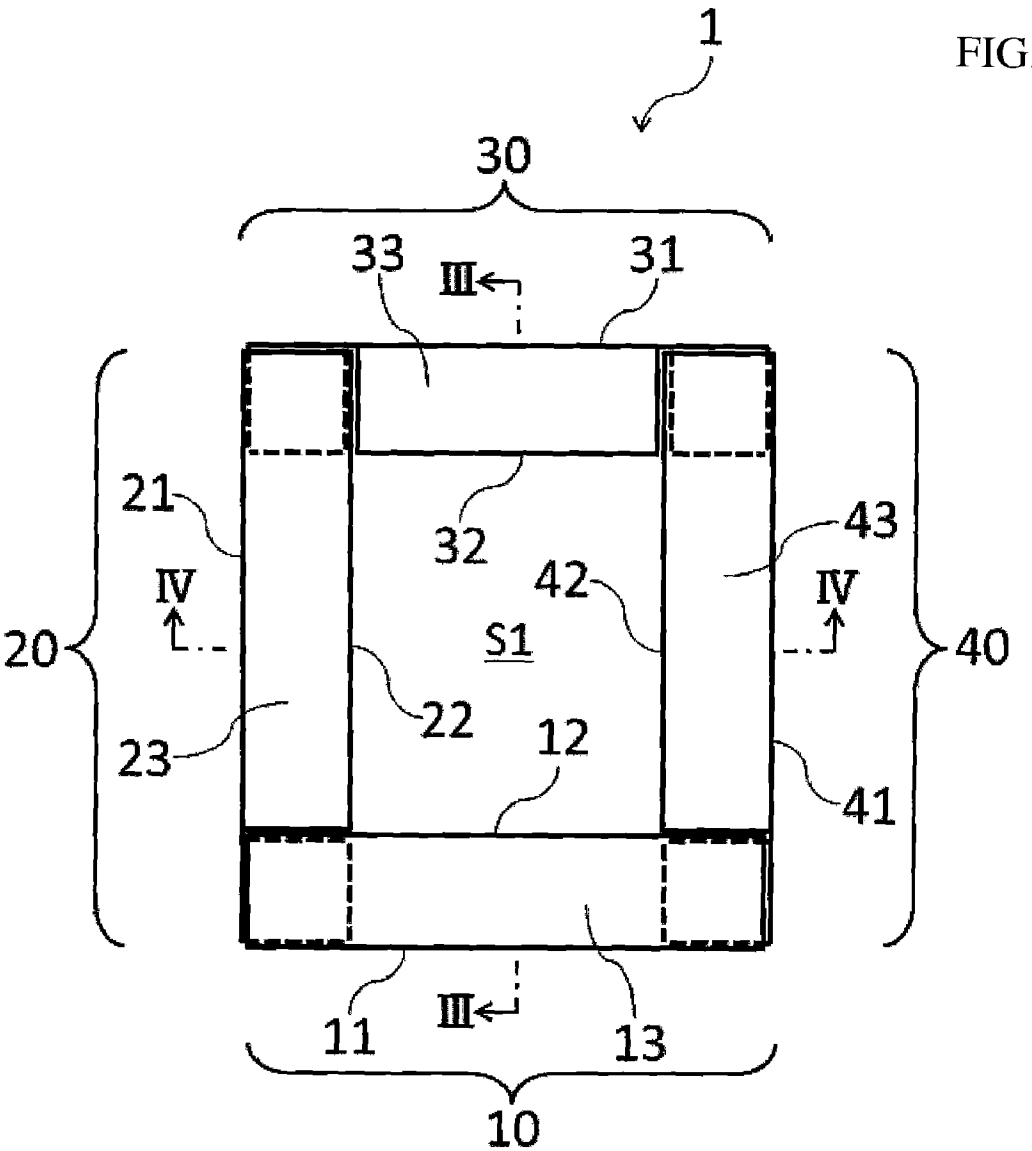
FIG. 2 is a plan view of the ready-to-assemble toilet shown in FIG. 1.
Figure 3:
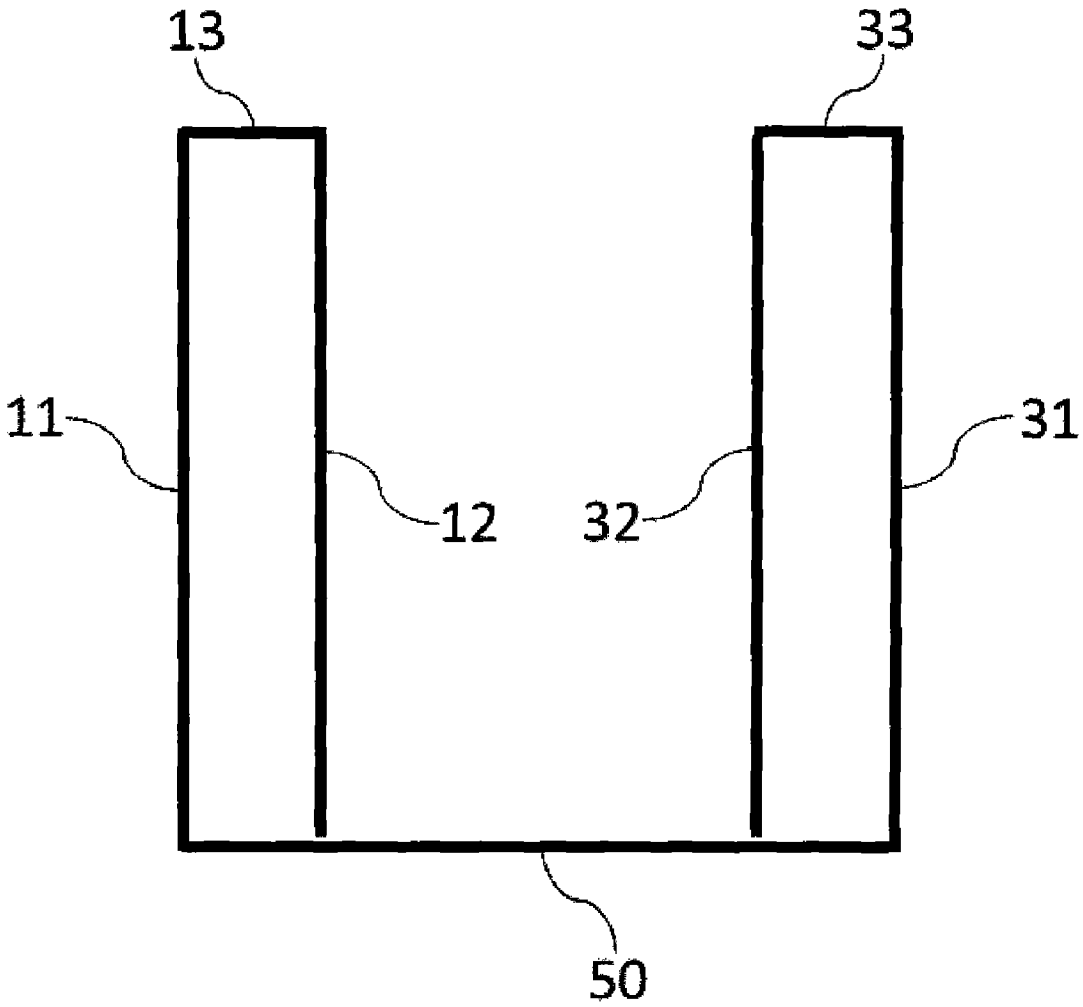
FIG. 3 is a cross-section view taken along the line III-III of FIG. 2.
Figure 4:
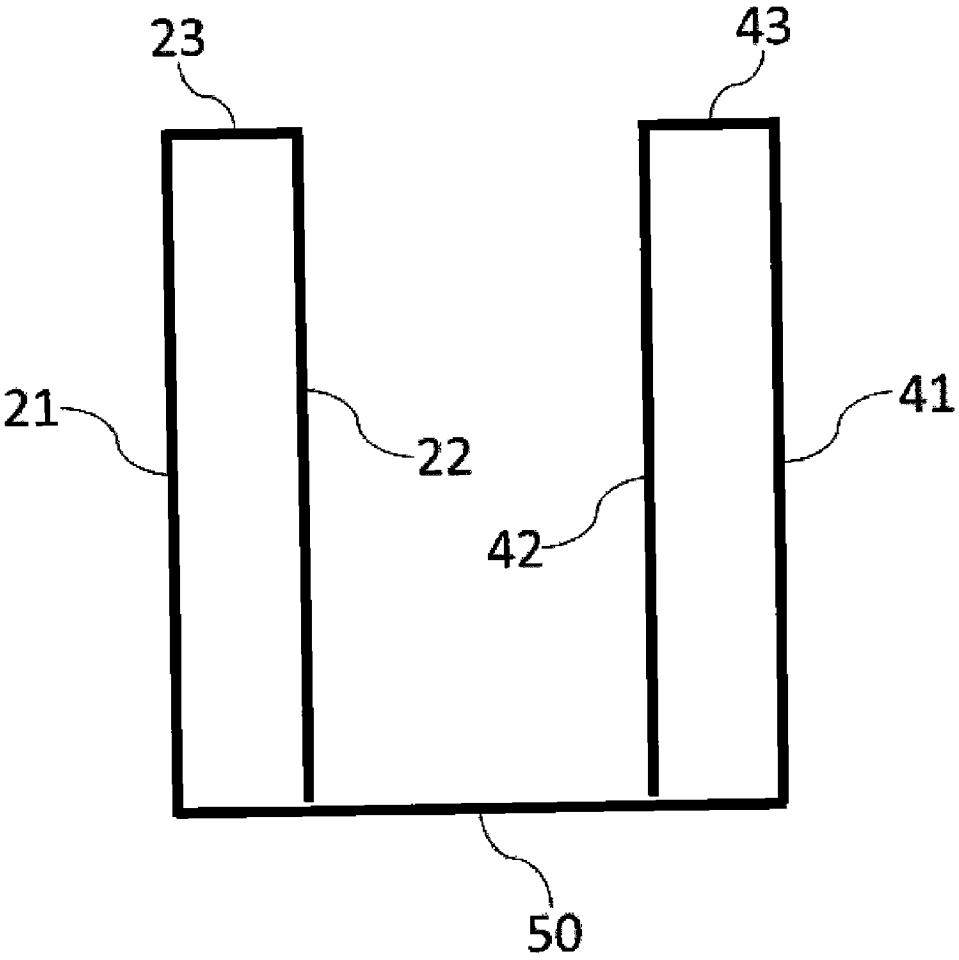
FIG. 4 is a cross-section view taken along the line IV-IV of FIG. 2.

FIG. 1 is a perspective view of a ready-to-assemble toilet according to the first embodiment of the present invention. FIG. 2 is a plan view of the ready-to-assemble toilet shown in FIG. 1. FIG. 3 and FIG. 4 are cross-section views taken along the line III-III and the line IV-IV of FIG. 2, respectively. The ready-to-assemble toilet 1 is a box-shaped ready-to-assemble toilet made of corrugated board or cardboard. The ready-to-assemble toilet 1 has a rectangular parallelepiped shape including a sidewall portion 10 (first sidewall portion), a sidewall portion 20 (second sidewall portion), a sidewall portion 30 (third sidewall portion), a sidewall portion 40 (fourth sidewall portion), and a bottom portion 50. The ready-to-assemble toilet 1 is sized to have, for example, a width (the horizontal length of each of the sidewall portions 10 and 30) of about 45 cm, a depth (the horizontal length of each of the sidewall portions 20 and 40) of about 50 cm, and a height (the height of each of the sidewall portions 10, 20, 30 and 40) of about 50 cm.

The sidewall portion 10 includes an outer sidewall 11, an inner sidewall 12, and a horizontal wall 13. The outer sidewall 11, the inner sidewall 12 and the horizontal wall 13 each have a rectangular shape. The inner sidewall 12 faces the outer sidewall 11. To be specific, the outer sidewall 11 and the inner sidewall 12 are each perpendicular to the bottom portion 50, and parallel to each other. In the present embodiment, the outer sidewall 11 and the inner sidewall 12 have a substantially equal shape and size. That is, the horizontal length of the outer sidewall 11 is substantially equal to the horizontal length of the inner sidewall 12, and the vertical length of the outer sidewall 11 is substantially equal to the vertical length of the inner sidewall 12. Accordingly, the inner sidewall 12 faces the entirety of the outer sidewall 11. The lower end of the inner sidewall 12 reaches the bottom portion 50 as shown in FIG. 3. The horizontal wall 13 connects the upper end of the outer sidewall 11 and the upper end of the inner sidewall 12.

The sidewall portion 20 includes an outer sidewall 21, an inner sidewall 22, and a horizontal wall 23. The outer sidewall 21, the inner sidewall 22 and the horizontal wall 23 each have a rectangular shape. The inner sidewall 22 faces the outer sidewall 21. To be specific, the outer sidewall 21 and the inner sidewall 22 are each perpendicular to the bottom portion 50, and parallel to each other. In the present embodiment, the outer sidewall 21 and the inner sidewall 22 have a substantially equal shape and size. That is, the horizontal length of the outer sidewall 21 is substantially equal to the horizontal length of the inner sidewall 22, and the vertical length of the outer sidewall 21 is substantially equal to the vertical length of the inner sidewall 22. Accordingly, the inner sidewall 22 faces the entirety of the outer sidewall 21. The lower end of the inner sidewall 22 reaches the bottom portion 50 as shown in FIG. 4. The horizontal wall 23 connects the upper end of the outer sidewall 21 and the upper end of the inner sidewall 22.

The sidewall portion 30 includes an outer sidewall 31, an inner sidewall 32, and a horizontal wall 33. The outer sidewall 31, the inner sidewall 32 and the horizontal wall 33 each have a rectangular shape. The inner sidewall 32 faces the outer sidewall 31. To be specific, the outer sidewall 31 and the inner sidewall 32 are each perpendicular to the bottom portion 50, and parallel to each other. In the present embodiment, the outer sidewall 31 and the inner sidewall 32 have a substantially equal shape and size. That is, the horizontal length of the outer sidewall 31 is substantially equal to the horizontal length of the inner sidewall 32, and the vertical length of the outer sidewall 31 is substantially equal to the vertical length of the inner sidewall 32. Accordingly, the inner sidewall 32 faces the entirety of the outer sidewall 31. The lower end of the inner sidewall 32 reaches the bottom portion 50 as shown in FIG. 3. The horizontal wall 33 connects the upper end of the outer sidewall 31 and the upper end of the inner sidewall 32.

The sidewall portion 40 includes an outer sidewall 41, an inner sidewall 42, and a horizontal wall 43. The outer sidewall 41, the inner sidewall 42 and the horizontal wall 43 each have a rectangular shape. The inner sidewall 42 faces the outer sidewall 41. To be specific, the outer sidewall 41 and the inner sidewall 42 are each perpendicular to the bottom portion 50, and parallel to each other. In the present embodiment, the outer sidewall 41 and the inner sidewall 42 have a substantially equal shape and size. That is, the horizontal length of the outer sidewall 41 is substantially equal to the horizontal length of the inner sidewall 42, and the vertical length of the outer sidewall 41 is substantially equal to the vertical length of the inner sidewall 42. Accordingly, the inner sidewall 42 faces the entirety of the outer sidewall 41. The lower end of the inner sidewall 42 reaches the bottom portion 50 as shown in FIG. 4. The horizontal wall 43 connects the upper end of the outer sidewall 41 and the upper end of the inner sidewall 42.

The horizontal wall 13 of the sidewall portion 10 and the horizontal wall 23 of the sidewall portion 20 overlap each other as shown in FIG. 1 and FIG. 2. To be specific, one end part of the horizontal wall 13 of the sidewall portion 10 overlies one end part of the horizontal wall 23 of the sidewall portion 20. The horizontal wall 23 of the sidewall portion 20 and the horizontal wall 33 of the sidewall portion 30 overlap each other. To be specific, the other end part of the horizontal wall 23 of the sidewall portion 20 overlies one end part of the horizontal wall 33 of the sidewall portion 30. The horizontal wall 33 of the sidewall portion 30 and the horizontal wall 43 of the sidewall portion 40 overlap each other. To be specific, one end part of the horizontal wall 43 of the sidewall portion 40 overlies the other end part of the horizontal wall 33 of the sidewall portion 30. The horizontal wall 43 of the sidewall portion 40 and the horizontal wall 13 of the sidewall portion 10 overlap each other. To be specific, the other end part of the horizontal wall 13 of the sidewall portion 10 overlies the other end part of the horizontal wall 43 of the sidewall portion 40.

In the ready-to-assemble toilet 1, the horizontal walls 13, 23, 33 and 43 of the sidewall portions 10, 20, 30 and 40 together function as a toilet seat. A space S1 surrounded by the sidewall portions 10, 20, 30 and 40 is used to collect excrement. Before the ready-to-assemble toilet 1 is used, a bag (not shown) for accommodating excrement is provided in the space S1. The bag can be, for example, a polyethylene bag. Preferably, the bag contains an excrement treatment material that absorbs excrement.

Figure 5:
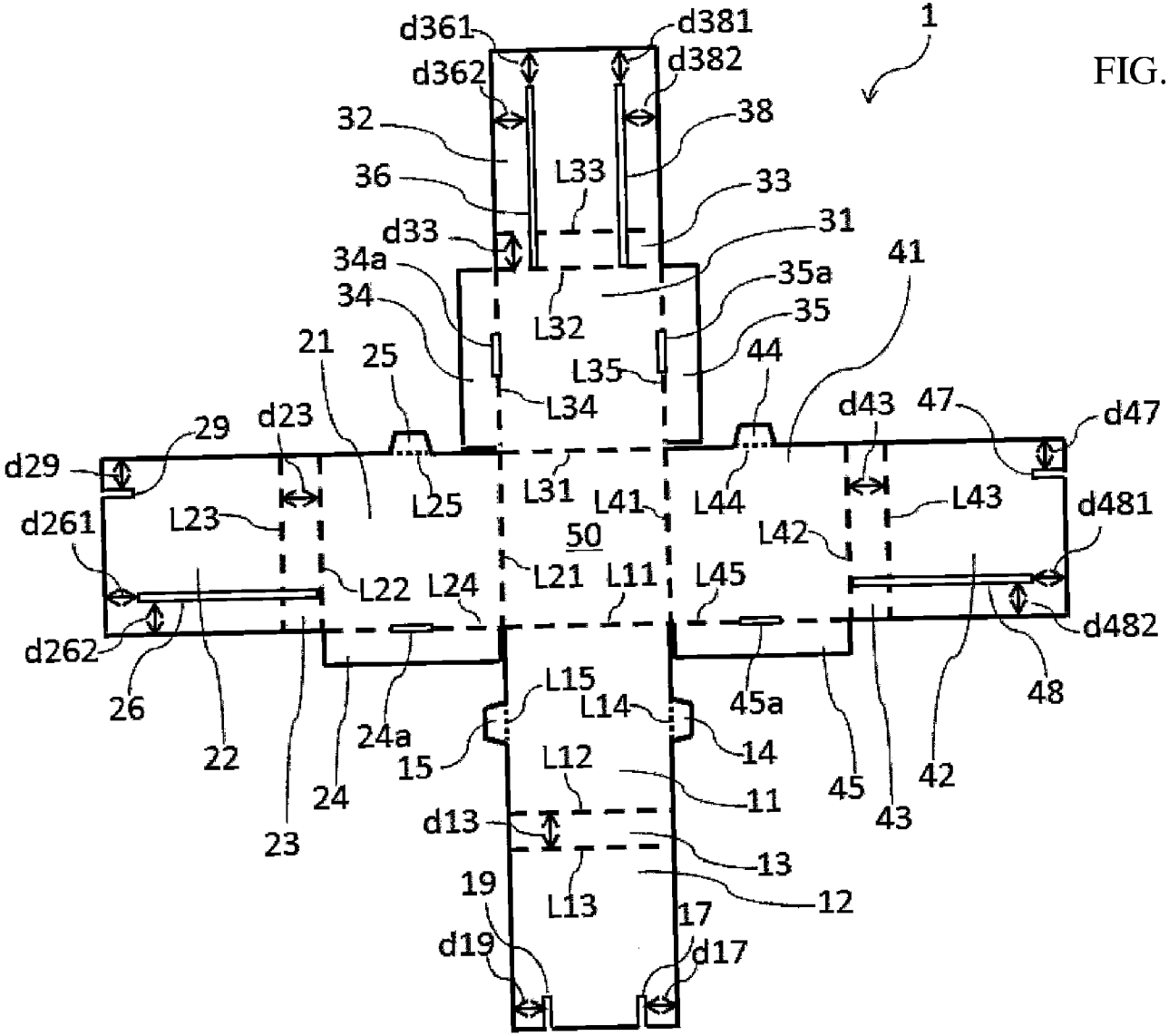
FIG. 5 is a plan view of the ready-to-assemble toilet shown in FIG. 1 before being assembled.

FIG. 5 is a plan view of the ready-to-assemble toilet 1 before being assembled. This diagram shows the internal side of the ready-to-assemble toilet 1. The ready-to-assemble toilet 1 is formed of a single sheet of flat corrugated board or cardboard. The sidewall portions 10, 20, 30 and 40 are connected respectively to four sides of the bottom portion 50.

To be specific, the outer sidewall 11 of the sidewall portion 10 is connected to one side (the bottom side in FIG. 5) of the bottom portion 50. In the sidewall portion 10, the horizontal wall 13 is connected to the outer sidewall 11, and the inner sidewall 12 is connected to the horizontal wall 13. A folding line L11 is formed at the boundary between the bottom portion 50 and the outer sidewall 11. A folding line L12 is formed at the boundary between the outer sidewall 11 and the horizontal wall 13. A folding line L13 is formed at the boundary between the horizontal wall 13 and the inner sidewall 12. In the present embodiment, the sidewall portion 10 is formed of a single sheet of corrugated board or cardboard having the folding lines L12 and L13. The sidewall portion 10 is configured such that the outer sidewall 11, the inner sidewall 12 facing the outer sidewall 11 and the horizontal wall 13 connecting the upper ends of the outer sidewall 11 and the inner sidewall 12 are formed by folding along the folding lines L12 and L13.

A tab 14 and a tab 15 are connected respectively to opposite sides of the outer sidewall 11. The tab 14 is inserted into a hole 45*a* of the sidewall portion 40 described later. A folding line L14 is formed at the boundary between the outer sidewall 11 and the tab 14. The tab 15 is inserted into a hole 24*a* of the sidewall portion 20 described later. A folding line L15 is formed at the boundary between the outer sidewall 11 and the tab 15.

A cut 17 (fourth cut) and a cut 19 (first cut) are formed in the inner sidewall 12. The cuts 17 and 19 each extend from the lower end (the end opposite to the horizontal wall 13) of the inner sidewall 12 to a middle of the inner sidewall 12. The distance d17 between the cut 17 and one side end of the inner sidewall 12 is substantially equal to the width d43 of the horizontal wall 43 of the sidewall portion 40. The distance d19 between the cut 19 and the other side end of the inner sidewall 12 is substantially equal to the width d23 of the horizontal wall 23 of the sidewall portion 20.

The outer sidewall 21 of the sidewall portion 20 is connected to another side (the left side in FIG. 5) of the bottom portion 50. In the sidewall portion 20, the horizontal wall 23 is connected to the outer sidewall 21, and the inner sidewall 22 is connected to the horizontal wall 23. A folding line L21 is formed at the boundary between the bottom portion 50 and the outer sidewall 21. A folding line L22 is formed at the boundary between the outer sidewall 21 and the horizontal wall 23. A folding line L23 is formed at the boundary between the horizontal wall 23 and the inner sidewall 22. In the present embodiment, the sidewall portion 20 is formed of a single sheet of corrugated board or cardboard having the folding lines L22 and L23. The sidewall portion 20 is configured such that the outer sidewall 21, the inner sidewall 22 facing the outer sidewall 21 and the horizontal wall 23 connecting the upper ends of the outer sidewall 21 and the inner sidewall 22 are formed by folding along the folding lines L22 and L23.

A reinforcing wall 24 and a tab 25 are connected respectively to opposite sides of the outer sidewall 21. The reinforcing wall 24 is provided so as to overlap the outer sidewall 11 of the sidewall portion 10 in the ready-to-assemble toilet 1 after being assembled. A folding line L24 is formed at the boundary between the outer sidewall 21 and the reinforcing wall 24. A hole 24*a* is formed at a part of the folding line L24. The tab 15 described above is inserted into the hole 24*a*. The tab 25 is inserted into a hole 34*a* of the sidewall portion 30 described later. A folding line L25 is formed at the boundary between the outer sidewall 21 and the tab 25.

A slit 26 (first slit) is formed from the horizontal wall 23 to the inner sidewall 22. In the present embodiment, the slit 26 is formed from the horizontal wall 23 to a middle of the inner sidewall 22. That is, the slit 26 extends from the folding line L22 to the middle of the inner sidewall 22. The inner sidewall 12 of the sidewall portion 10 is inserted into the slit 26. To be specific, the part of the inner sidewall 12 which is on the extension line of the cut 19 is inserted into the slit 26. At this time, the cut 19 is engaged with the part of the inner sidewall 22 where the slit 26 is not formed (the part on the extension line of the slit 26). The distance d261 between the slit 26 and the lower end of the inner sidewall 22 is substantially equal to the length of the cut 19. The distance d262 between the slit 26 and one side end of the inner sidewall 22 is substantially equal to the width d13 of the horizontal wall 13 of the sidewall portion 10.

Furthermore, a cut 29 (second cut) is formed in the inner sidewall 22. The cut 29 extends from the lower end (the end opposite to the horizontal wall 23) of the inner sidewall 22 to a middle of the inner sidewall 22. The distance d29 between the cut 29 and the other side end of the inner sidewall 22 is substantially equal to the width d33 of the horizontal wall 33 of the sidewall portion 30.

The outer sidewall 31 of the sidewall portion 30 is connected to another side (the top side in FIG. 5) of the bottom portion 50. In the sidewall portion 30, the horizontal wall 33 is connected to the outer sidewall 31, and the inner sidewall 32 is connected to the horizontal wall 33. A folding line L31 is formed at the boundary between the bottom portion 50 and the outer sidewall 31. A folding line L32 is formed at the boundary between the outer sidewall 31 and the horizontal wall 33. A folding line L33 is formed at the boundary between the horizontal wall 33 and the inner sidewall 32. In the present embodiment, the sidewall portion 30 is formed of a single sheet of corrugated board or cardboard having the folding lines L32 and L33. The sidewall portion 30 is configured such that the outer sidewall 31, the inner sidewall 32 facing the outer sidewall 31 and the horizontal wall 33 connecting the upper ends of the outer sidewall 31 and the inner sidewall 32 are formed by folding along the folding lines L32 and L33.

A reinforcing wall 34 and a reinforcing wall 35 are connected respectively to opposite sides of the outer sidewall 31. The reinforcing wall 34 is provided so as to overlap the outer sidewall 21 of the sidewall portion 20 in the ready-to-assemble toilet 1 after being assembled. A folding line L34 is formed at the boundary between the outer sidewall 31 and the reinforcing wall 34. A hole 34*a* is formed at a part of the folding line L34. The tab 25 described above is inserted into the hole 34*a*. The reinforcing wall 35 is provided so as to overlap the outer sidewall 41 of the sidewall portion 40 in the ready-to-assemble toilet 1 after being assembled. A folding line L35 is formed at the boundary between the outer sidewall 31 and the reinforcing wall 35. A hole 35*a* is formed at a part of the folding line L35. A tab 44 of the sidewall portion 40 described later is inserted into the hole 35*a*.

A slit 36 (second slit) and a slit 38 (third slit) are formed from the horizontal wall 33 to the inner sidewall 32. In the present embodiment, the slits 36 and 38 are each formed from the horizontal wall 33 to a middle of the inner sidewall 32. That is, the slits 36 and 38 each extend from the folding line L32 to the middle of the inner sidewall 32.

The inner sidewall 22 of the sidewall portion 20 is inserted into the slit 36. To be specific, the part of the inner sidewall 22 which is on the extension line of the cut 29 is inserted into the slit 36. At this time, the cut 29 is engaged with the part of the inner sidewall 32 where the slit 36 is not formed (the part on the extension line of the slit 36). The distance d361 between the slit 36 and the lower end of the inner sidewall 32 is substantially equal to the length of the cut 29. The distance d362 between the slit 36 and one side end of the inner sidewall 32 is substantially equal to the width d23 of the horizontal wall 23 of the sidewall portion 20. The inner sidewall 42 of the sidewall portion 40 is inserted into the slit 38 as described later. The distance d382 between the slit 38 and the other side end of the inner sidewall 32 is substantially equal to the width d43 of the horizontal wall 43 of the sidewall portion 40.

The outer sidewall 41 of the sidewall portion 40 is connected to the other side (the right side in FIG. 5) of the bottom portion 50. In the sidewall portion 40, the horizontal wall 43 is connected to the outer sidewall 41, and the inner sidewall 42 is connected to the horizontal wall 43. A folding line L41 is formed at the boundary between the bottom portion 50 and the outer sidewall 41. A folding line L42 is formed at the boundary between the outer sidewall 41 and the horizontal wall 43. A folding line L43 is formed at the boundary between the horizontal wall 43 and the inner sidewall 42. In the present embodiment, the sidewall portion 40 is formed of a single sheet of corrugated board or cardboard having the folding lines L42 and L43. The sidewall portion 40 is configured such that the outer sidewall 41, the inner sidewall 42 facing the outer sidewall 41 and the horizontal wall 43 connecting the upper ends of the outer sidewall 41 and the inner sidewall 42 are formed by folding along the folding lines L42 and L43.

A tab 44 and a reinforcing wall 45 are connected respectively to opposite sides of the outer sidewall 41. The tab 44 is inserted into the hole 35*a* described above. A folding line L44 is formed at the boundary between the outer sidewall 41 and the tab 44. The reinforcing wall 45 is provided so as to overlap the outer sidewall 11 of the sidewall portion 10 in the ready-to-assemble toilet 1 after being assembled. A folding line L45 is formed at the boundary between the outer sidewall 41 and the reinforcing wall 45. A hole 45*a* is formed at a part of the folding line L45. The tab 14 described above is inserted into the hole 45*a*.

A cut 47 (third cut) is formed in the inner sidewall 42. The cut 47 extends from the lower end (the end opposite to the horizontal wall 43) of the inner sidewall 42 to a middle of the inner sidewall 42. The inner sidewall 42 is inserted into the slit 38 described above. To be specific, the part of the inner sidewall 42 which is on the extension line of the cut 47 is inserted into the slit 38. At this time, the cut 47 is engaged with the part of the inner sidewall 32 where the slit 38 is not formed (the part on the extension line of the slit 38). The length of the cut 47 is substantially equal to the distance d381 between the slit 38 and the lower end of the inner sidewall 32. The distance d47 between the cut 47 and one side end of the inner sidewall 42 is substantially equal to the width d33 of the horizontal wall 33 of the sidewall portion 30.

A slit 48 (fourth slit) is formed from the horizontal wall 43 to the inner sidewall 42. In the present embodiment, the slit 48 is formed from the horizontal wall 43 to a middle of the inner sidewall 42. That is, the slit 48 extends from the folding line L42 to the middle of the inner sidewall 42. The inner sidewall 12 of the sidewall portion 10 is inserted into the slit 48. To be specific, the part of the inner sidewall 12 which is on the extension line of the cut 17 is inserted into the slit 48. At this time, the cut 17 is engaged with the part of the inner sidewall 42 where the slit 48 is not formed (the part on the extension line of the slit 48). The distance d481 between the slit 48 and the lower end of the inner sidewall 42 is substantially equal to the length of the cut 17. The distance d482 between the slit 48 and the other side end of the inner sidewall 42 is substantially equal to the width d13 of the horizontal wall 13 of the sidewall portion 10.

Figure 6:
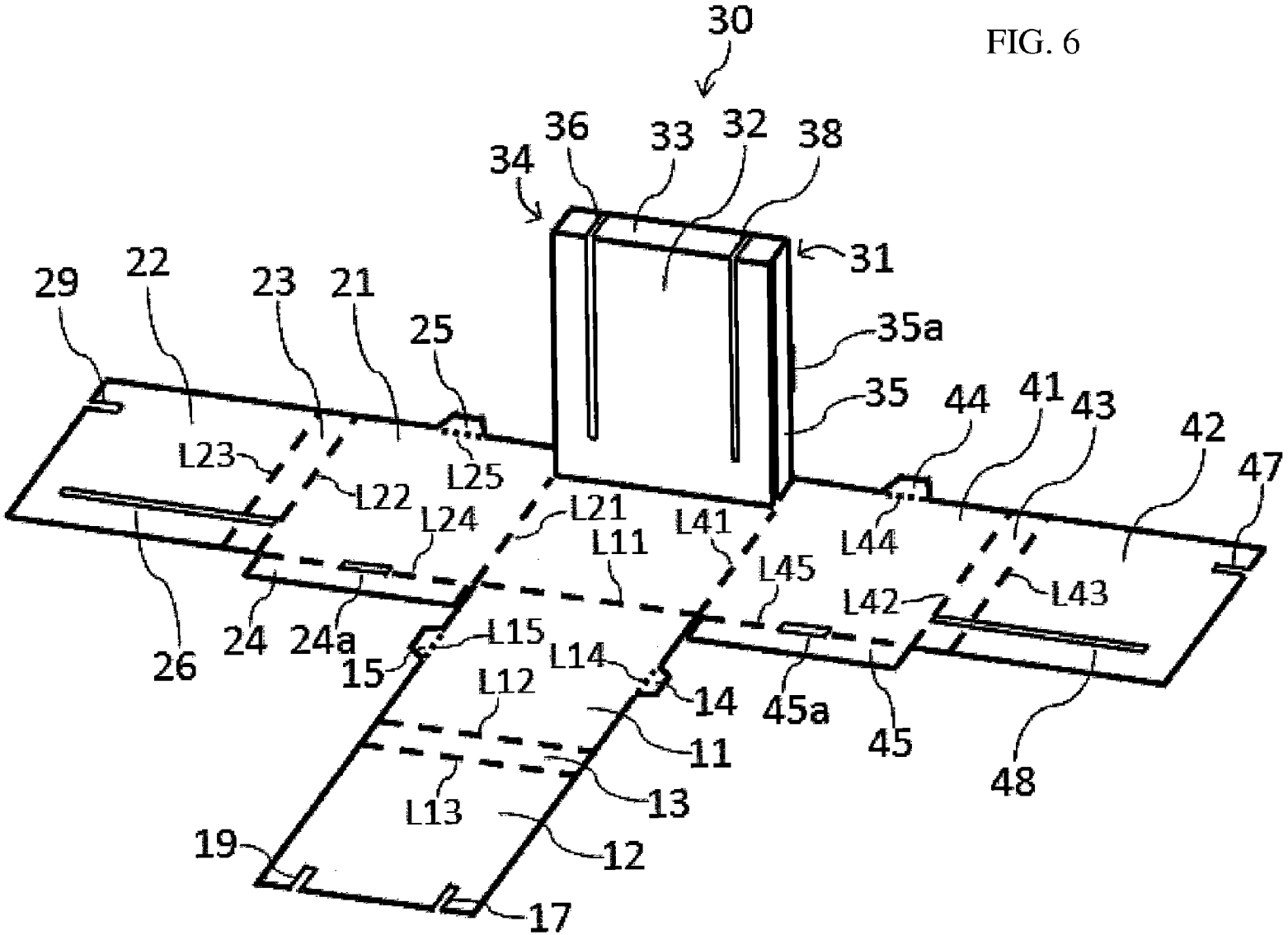
FIG. 6 is a diagram illustrating an assembly procedure of the ready-to-assemble toilet shown in FIG. 1.
Figure 7:
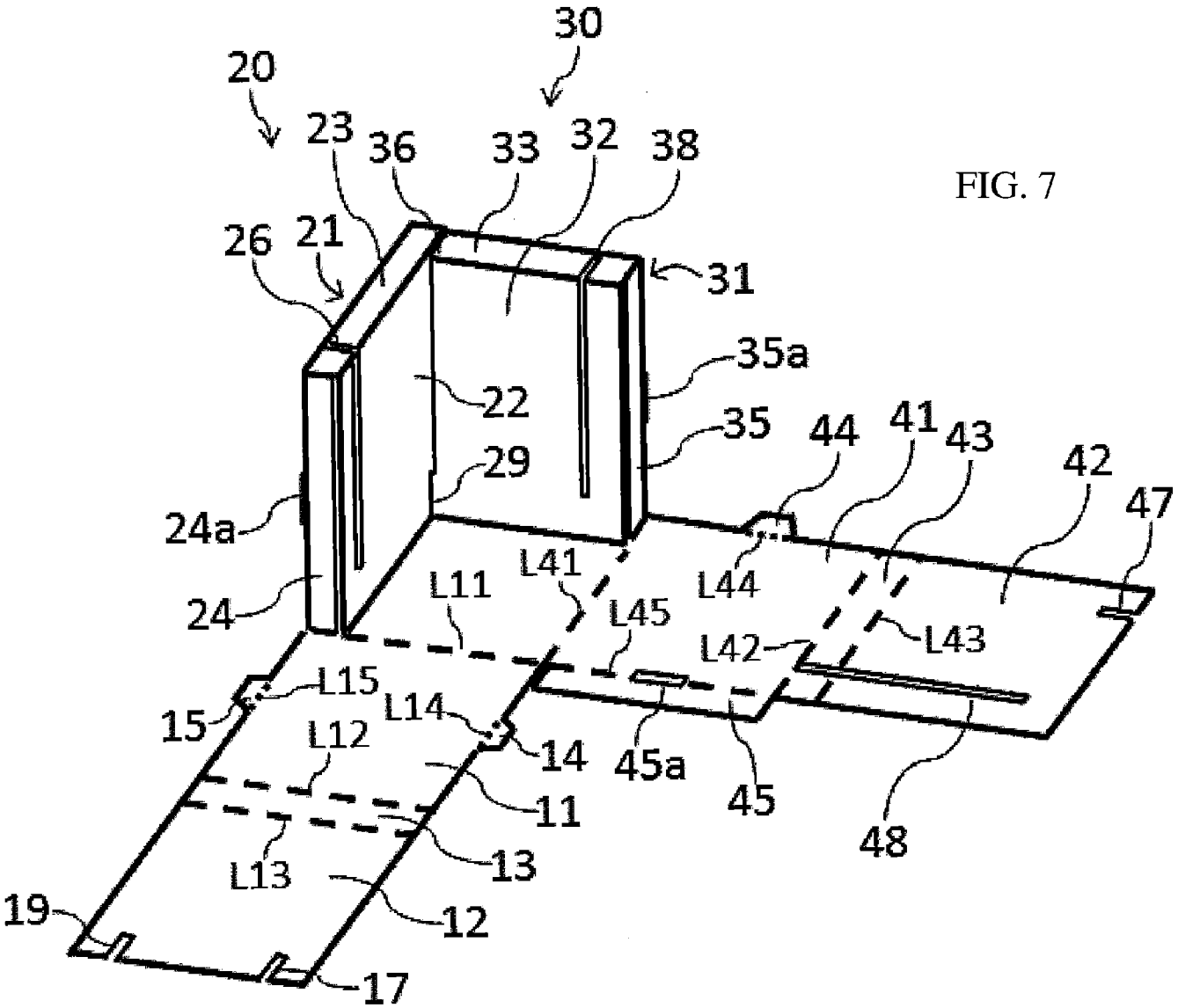
FIG. 7 is a diagram illustrating the assembly procedure of the ready-to-assemble toilet shown in FIG. 1.
Figure 8:
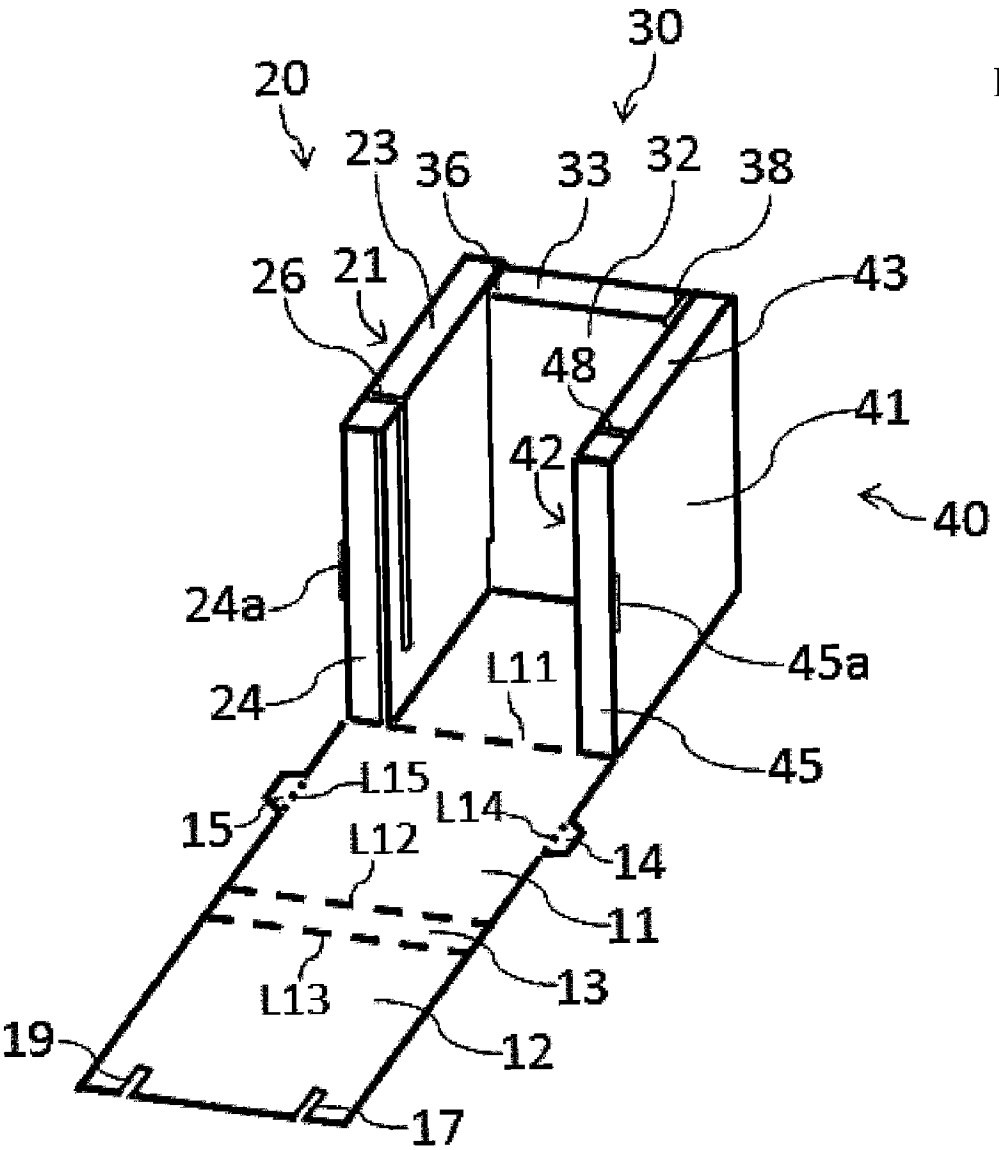
FIG. 8 is a diagram illustrating the assembly procedure of the ready-to-assemble toilet shown in FIG. 1.

An assembly procedure of the ready-to-assemble toilet 1 will be described with reference to FIG. 6 to FIG. 8. First, the sidewall portion 30 is assembled by folding along the folding lines L31 to L35. To be specific, the sidewall portion 30 standing upright on the bottom portion 50 is obtained by folding along the folding lines L31 to L35 to form valley folds having a substantially right angle as shown in FIG. 6.

Next, the sidewall portion 20 is assembled by folding along the folding lines L21 to L25. To be specific, the sidewall portion 20 standing upright on the bottom portion 50 is obtained by folding along the folding lines L21 to L25 to form valley folds having a substantially right angle as shown in FIG. 7. At this time, the tab 25 is inserted into the hole 34*a* of the sidewall portion 30. Also, the inner sidewall 22 is inserted into the slit 36 such that the cut 29 is engaged with the part of the inner sidewall 32 which is on the extension line of the slit 36. Thus, the reinforcing wall 34 overlies the internal surface of the outer sidewall 21. The reinforcing wall 34 and the outer sidewall 21 may be bonded to each other. An adhesive or double-sided tape can be used for the bonding.

Likewise, the sidewall portion 40 is assembled by folding along the folding lines L41 to L45. To be specific, the sidewall portion 40 standing upright on the bottom portion 50 is obtained by folding along the folding lines L41 to L45 to form valley folds having a substantially right angle as shown in FIG. 8. At this time, the tab 44 is inserted into the hole 35*a* of the sidewall portion 30. Also, the inner sidewall 42 is inserted into the slit 38 such that the cut 47 is engaged with the part of the inner sidewall 32 which is on the extension line of the slit 38. Thus, the reinforcing wall 35 overlies the internal surface of the outer sidewall 41. The reinforcing wall 35 and the outer sidewall 41 may be bonded to each other. Assembly of the sidewall portion 40 may be performed prior to assembly of the sidewall portion 20 or concurrently with assembly of the sidewall portion 20.

Next, the sidewall portion 10 is assembled by folding along the folding lines L11 to L15. To be specific, the sidewall portion 10 standing upright on the bottom portion 50 is obtained by folding along the folding lines L11 to L15 to form valley folds having a substantially right angle as shown in FIG. 1. At this time, the tab 14 is inserted into the hole 45*a* of the sidewall portion 40, and the tab 15 is inserted into the hole 24*a* of the sidewall portion 20. Also, the inner sidewall 12 is inserted into the slit 48 such that the cut 17 is engaged with the part of the inner sidewall 42 which is on the extension line of the slit 48. Likewise, the inner sidewall 12 is inserted into the slit 26 such that the cut 19 is engaged with the part of the inner sidewall 22 which is on the extension line of the slit 26. Thus, the reinforcing walls 24 and 45 overlie the internal surface of the outer sidewall 11. The outer sidewall 11 may be bonded to each of the reinforcing walls 24 and 45. Accordingly, the ready-to-assemble toilet 1 shown in FIG. 1 is obtained.

Advantageous effects of the ready-to-assemble toilet 1 will be described. In the ready-to-assemble toilet 1, each of the sidewall portions 10, 20, 30 and 40 has a double-wall structure formed of the outer sidewalls 11, 21, 31 and 41, and the inner sidewalls 12, 22, 32 and 42. Furthermore, each of the sidewall portions 10, 20, 30 and 40 is provided with the horizontal walls 13, 23, 33 and 43 that connect the outer sidewalls 11, 21, 31 and 41, and the inner sidewalls 12, 22, 32 and 42. The horizontal walls 13, 23, 33 and 43 of the sidewall portions 10, 20, 30 and 40 each overlap the horizontal walls 13, 23, 33 and 43 of the adjacent sidewall portions 10, 20, 30 and 40. Accordingly, a structure where the sidewall portions 10, 20, 30 and 40 support each other is implemented, and therefore the strength of the ready-to-assemble toilet 1 can be remarkably enhanced.

Figure 9:
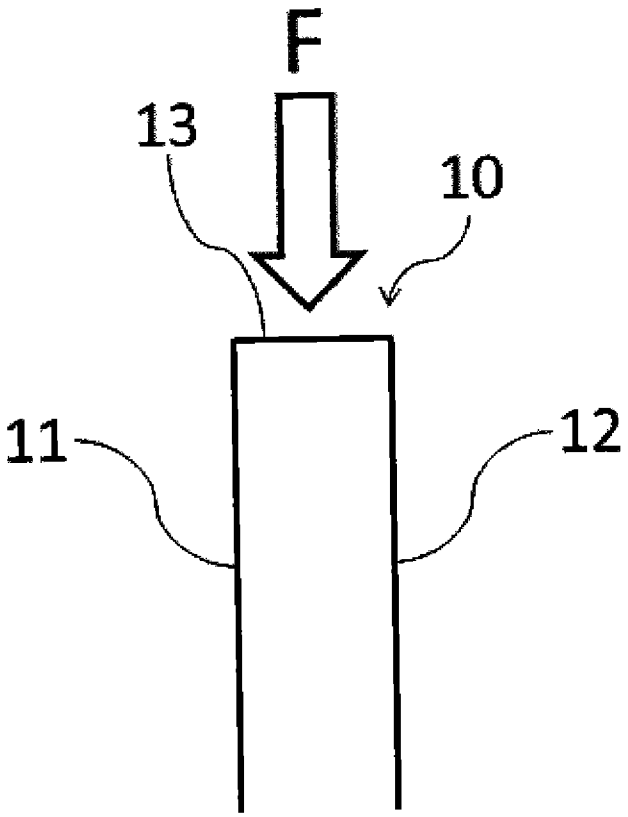
FIG. 9 is a diagram illustrating an advantageous effect of the ready-to-assemble toilet shown in FIG. 1.

In the sidewall portion 10, the outer sidewall 11 and the inner sidewall 12 are connected to each other at their upper ends via the horizontal wall 13. With this configuration, as shown in FIG. 9, even when a force F is applied to the sidewall portion 10 from above by a user being seated on the ready-to-assemble toilet 1, the distance between the outer sidewall 11 and the inner sidewall 12 is held constant, and thus the vertically upright state of the outer sidewall 11 and the inner sidewall 12 is likely to be maintained. For this reason, the outer sidewall 11 and the inner sidewall 12 can receive the force F from a direction parallel to the plane of the outer sidewall 11 and the inner sidewall 12, and thus easily exert strength against the force F.

Figure 10:
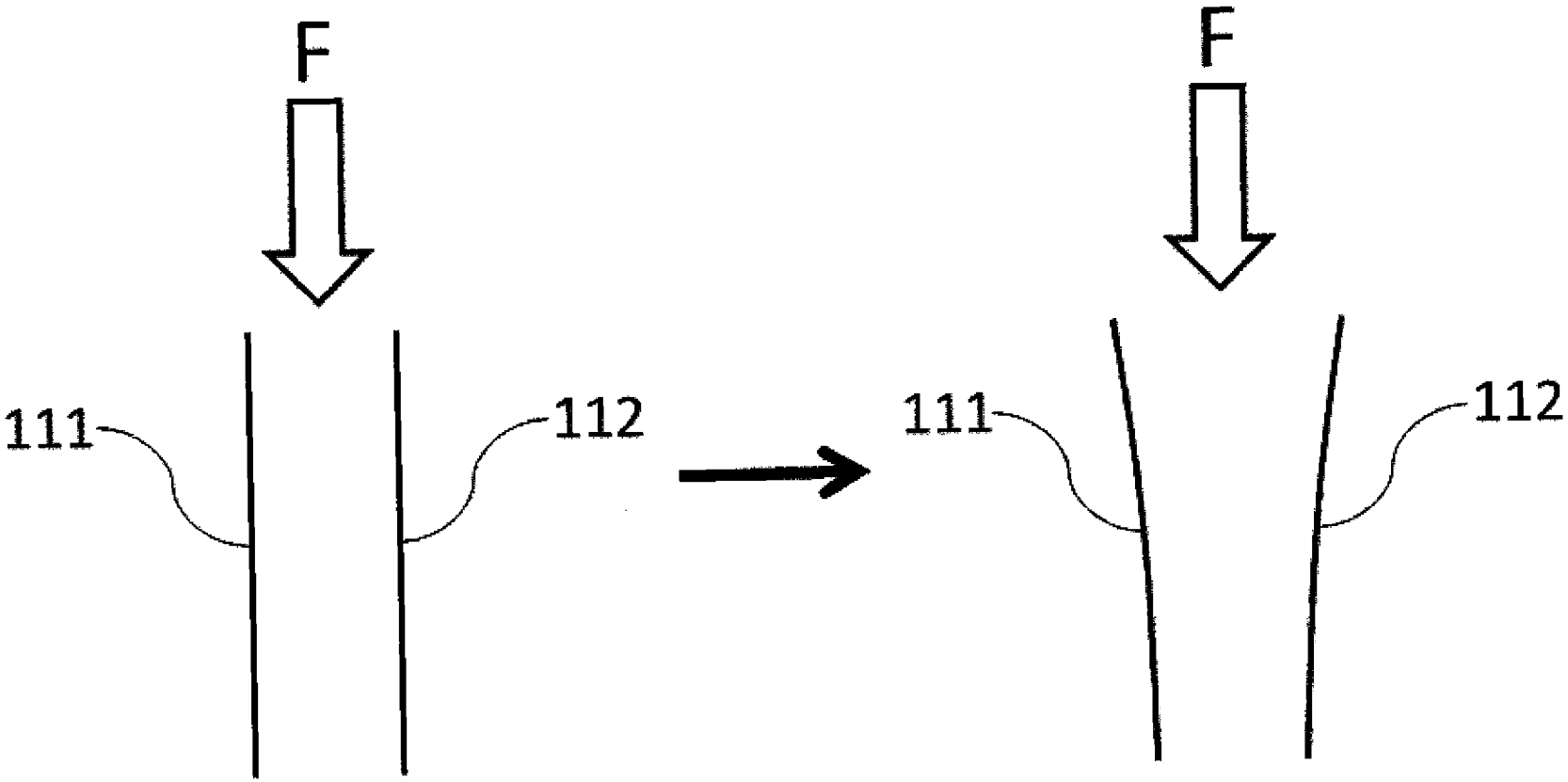
FIG. 10 is a diagram illustrating the advantageous effect of the ready-to-assemble toilet shown in FIG. 1.

In contrast, in the case of a structure as shown in FIG. 10 in which an outer sidewall 111 and an inner sidewall 112 are not connected to each other at their upper ends, application of a force F easily causes the distance between the outer sidewall 111 and the inner sidewall 112 to be changed, and thus the vertically upright state of the outer sidewall 111 and the inner sidewall 112 is unlikely to be maintained. This causes the outer sidewall 111 and the inner sidewall 112 to receive the force F from a diagonal direction with respect to the plane of the outer sidewall 111 and the inner sidewall 112, and thus strength against the force F is unlikely to be exerted.

As described above, in the ready-to-assemble toilet 1, the sidewall portion 10 has the horizontal wall 13 in addition to the outer sidewall 11 and the inner sidewall 12. This configuration advantageously serves to enhance the strength of the ready-to-assemble toilet 1. The same applies to the sidewall portions 20, 30 and 40.

The sidewall portion 20 has the slit 26. By inserting the inner sidewall 12 of the sidewall portion 10 into the slit 26, the horizontal wall 13 of the sidewall portion 10 overlies the horizontal wall 23 of the sidewall portion 20. Accordingly, the structure where the sidewall portions 10 and 20 support each other can be implemented with a simple configuration. In addition, it is possible to fix the sidewall portions 10 and 20 to each other firmly.

The slit 26 is formed from the horizontal wall 23 to the middle of the inner sidewall 22. The inner sidewall 12 of the sidewall portion 10 has the cut 19. The cut 19 is engaged with the part of the inner sidewall 22 which is on the extension line of the slit 26. Accordingly, it is possible to fix the sidewall portions 10 and 20 to each other more firmly.

The sidewall portion 30 has the slit 36. By inserting the inner sidewall 22 of the sidewall portion 20 into the slit 36, the horizontal wall 23 of the sidewall portion 20 overlies the horizontal wall 33 of the sidewall portion 30. Accordingly, the structure where the sidewall portions 20 and 30 support each other can be implemented with a simple configuration. In addition, it is possible to fix the sidewall portions 20 and 30 to each other firmly.

The slit 36 is formed from the horizontal wall 33 to the middle of the inner sidewall 32. The inner sidewall 22 of the sidewall portion 20 has the cut 29. The cut 29 is engaged with the part of the inner sidewall 32 which is on the extension line of the slit 36. Accordingly, it is possible to fix the sidewall portions 20 and 30 to each other more firmly.

The sidewall portion 30 has the slit 38. By inserting the inner sidewall 42 of the sidewall portion 40 into the slit 38, the horizontal wall 43 of the sidewall portion 40 overlies the horizontal wall 33 of the sidewall portion 30. Accordingly, the structure where the sidewall portions 30 and 40 support each other can be implemented with a simple configuration. In addition, it is possible to fix the sidewall portions 30 and 40 to each other firmly.

The slit 38 is formed from the horizontal wall 33 to the middle of the inner sidewall 32. The inner sidewall 42 of the sidewall portion 40 has the cut 47. The cut 47 is engaged with the part of the inner sidewall 32 which is on the extension line of the slit 38. Accordingly, it is possible to fix the sidewall portions 30 and 40 to each other more firmly.

The sidewall portion 40 has the slit 48. By inserting the inner sidewall 12 of the sidewall portion 10 into the slit 48, the horizontal wall 13 of the sidewall portion 10 overlies the horizontal wall 43 of the sidewall portion 40. Accordingly, the structure where the sidewall portions 40 and 10 support each other can be implemented with a simple configuration. In addition, it is possible to fix the sidewall portions 40 and 10 to each other firmly.

The slit 48 is formed from the horizontal wall 43 to the middle of the inner sidewall 42. The inner sidewall 12 of the sidewall portion 10 has the cut 17. The cut 17 is engaged with the part of the inner sidewall 42 which is on the extension line of the slit 48. Accordingly, it is possible to fix the sidewall portions 40 and 10 to each other more firmly.

The ready-to-assemble toilet 1 is provided with the tabs 14, 15, 25 and 44, and the holes 24*a*, 34*a*, 35*a* and 45*a*. By inserting the tab 14 into the hole 45*a*, it is possible to fix the sidewall portions 10 and 40 to each other even more firmly. By inserting the tab 15 into the hole 24*a*, it is possible to fix the sidewall portions 10 and 20 to each other even more firmly. By inserting the tab 25 into the hole 34*a*, it is possible to fix the sidewall portions 20 and 30 to each other even more firmly. By inserting the tab 44 into the hole 35*a*, it is possible to fix the sidewall portions 40 and 30 to each other even more firmly.

The sidewall portion 10 is formed of a single sheet of corrugated board or cardboard having the plurality of folding lines L12 and L13. By folding along the folding lines L12 and L13, the outer sidewall 11, the inner sidewall 12 and the horizontal wall 13 are formed. Accordingly, it is possible to easily assemble the sidewall portion 10 having the double-wall structure formed of the outer sidewall 11, the inner sidewall 12 and the horizontal wall 13. The same applies to the sidewall portions 20, 30 and 40.

The sidewall portion 10 has the reinforcing walls 24 and 45 provided so as to overlap the outer sidewall 11. Accordingly, it is possible to enhance the strength of the sidewall portion 10 and eventually the strength of the ready-to-assemble toilet 1. The sidewall portion 20 has the reinforcing wall 34 provided so as to overlap the outer sidewall 21. Accordingly, it is possible to enhance the strength of the sidewall portion 20 and eventually the strength of the ready-to-assemble toilet 1. The sidewall portion 40 has the reinforcing wall 35 provided so as to overlap the outer sidewall 41. Accordingly, it is possible to enhance the strength of the sidewall portion 40 and eventually the strength of the ready-to-assemble toilet 1.

In the ready-to-assemble toilet 1, the horizontal walls 13, 23, 33 and 43 of the sidewall portions 10, 20, 30 and 40 together function as a toilet seat. Accordingly, it is unnecessary to provide an additional member that functions as a toilet seat, and thus the structure of the ready-to-assemble toilet 1 can be simplified. Also, from the viewpoint of ease of use as a toilet seat, it is preferable that the horizontal wall 13 has the width d13 (see FIG. 5) of 5 cm or more and 15 cm or less, more preferably 8 cm or more and 12 cm or less. The same applies to the horizontal walls 23, 33 and 43.

The ready-to-assemble toilet 1 is made of corrugated board or cardboard. Accordingly, the ready-to-assemble toilet 1 can be easily discarded. In addition, corrugated board and cardboard are relatively light-weight, and thus ease of transport and transfer of the ready-to-assemble toilet 1 before and after assembly thereof can be achieved. Particularly, when the ready-to-assemble toilet 1 is made of corrugated board, the ready-to-assemble toilet 1 having an excellent deodorizing effect can be implemented.

The ready-to-assemble toilet 1 before being assembled is formed of a single sheet of flat corrugated board or cardboard. Accordingly, it is possible to save on storage space for the ready-to-assemble toilet 1 before being assembled. Furthermore, the ready-to-assemble toilet 1 is box-shaped, and thus is advantageous in that splashing of excrement out of the toilet is unlikely to occur.

(Second Embodiment)

Figure 11:
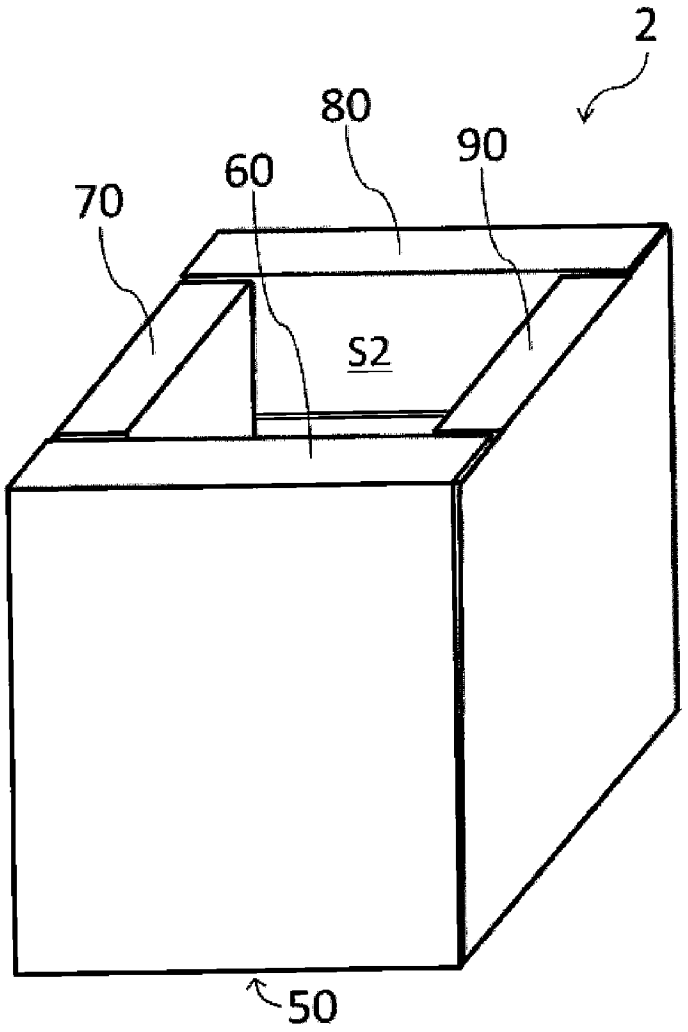
FIG. 11 is a perspective view of a ready-to-assemble toilet according to the second embodiment of the present invention.
Figure 12:
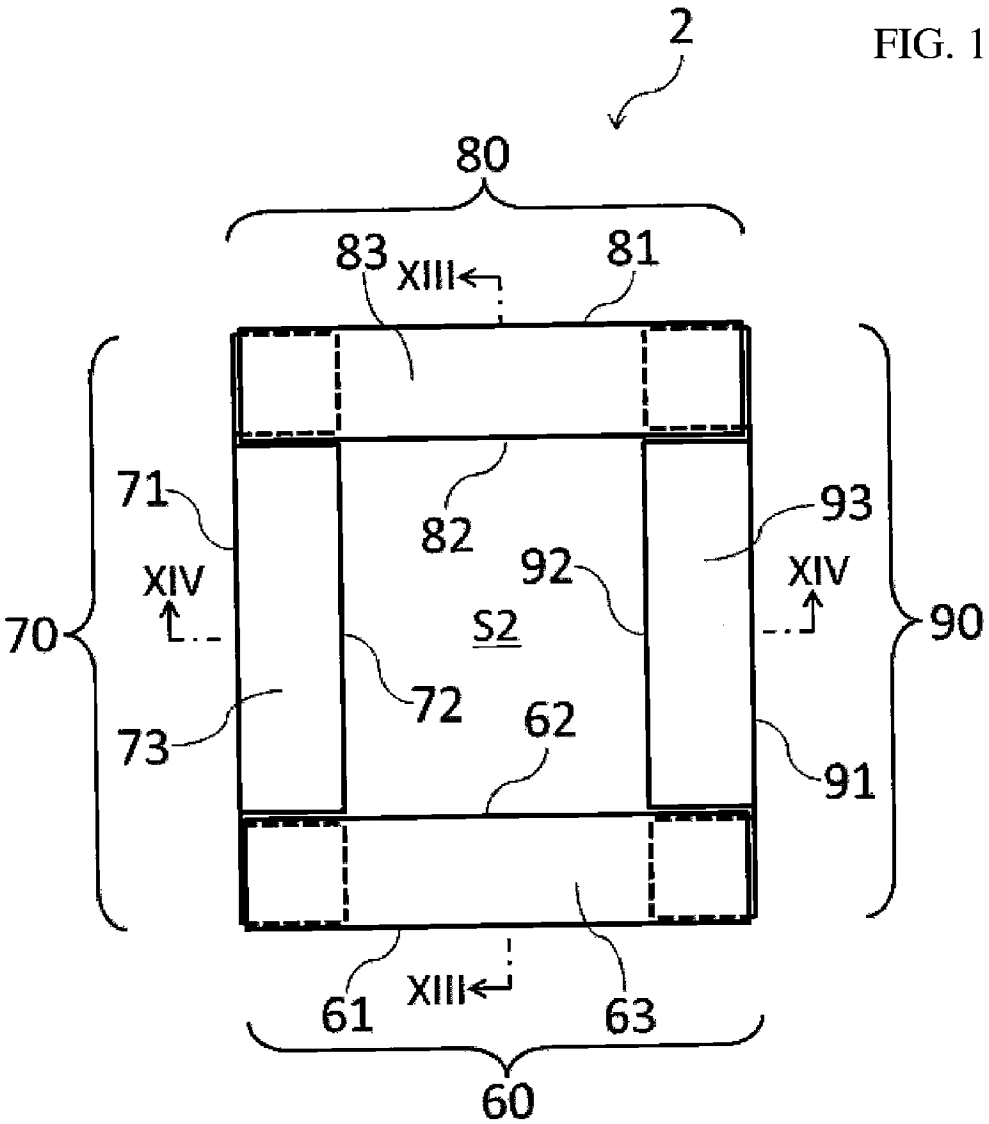
FIG. 12 is a plan view of the ready-to-assemble toilet shown in FIG. 11.
Figure 13:
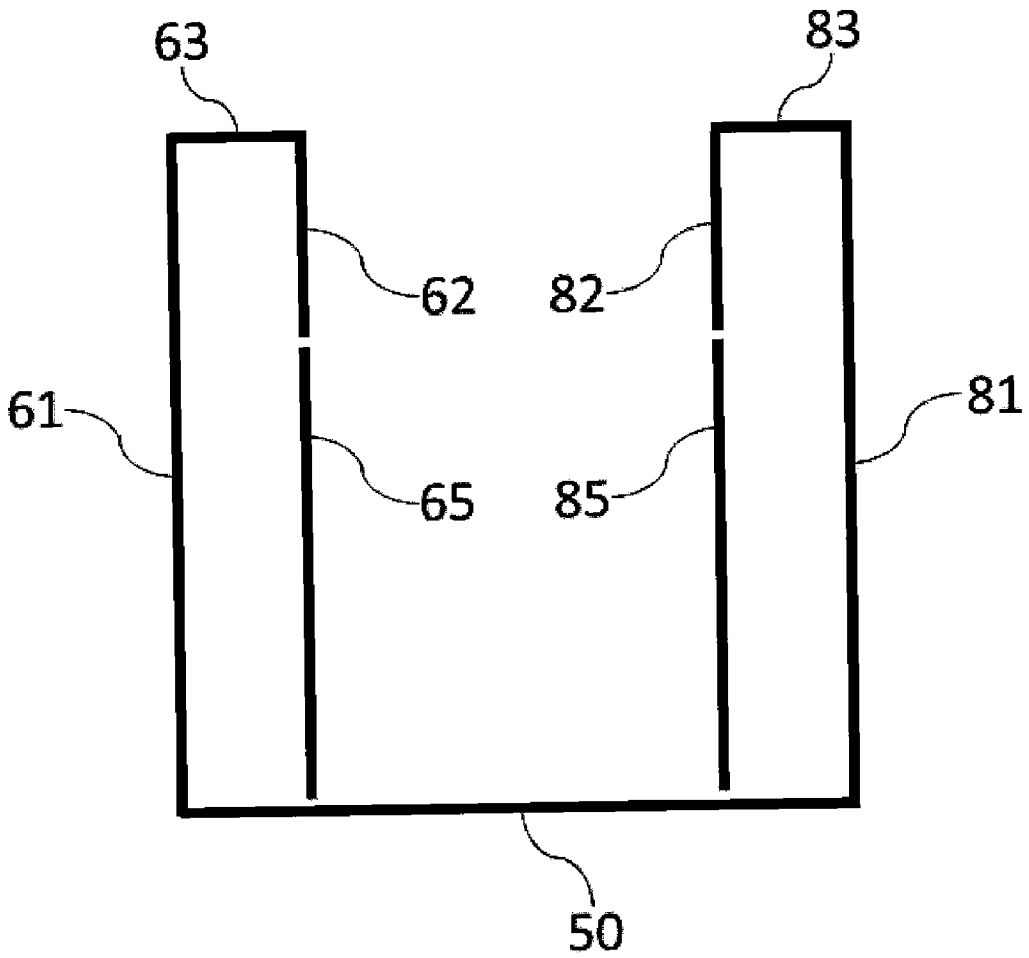
FIG. 13 is a cross-section view taken along the line XIII-XIII of FIG. 12.
Figure 14:
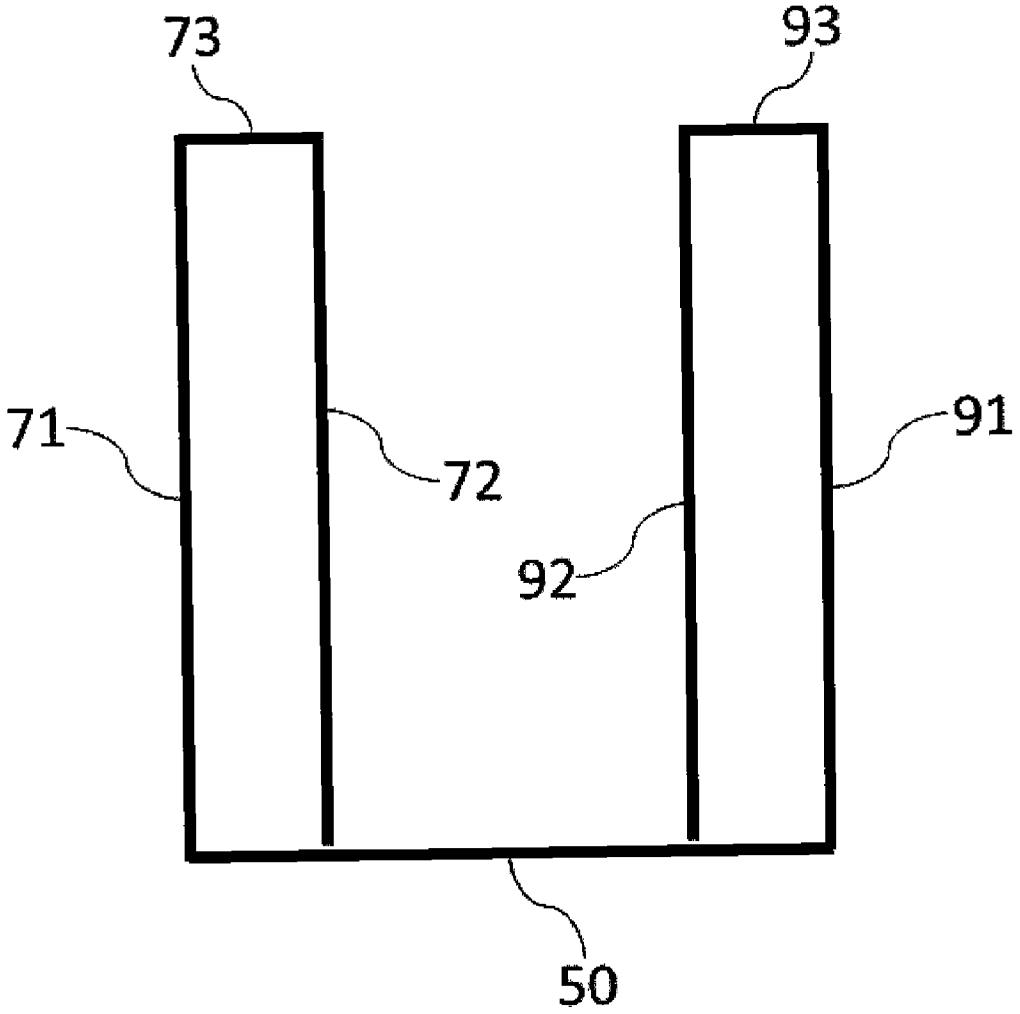
FIG. 14 is a cross-section view taken along the line XIV-XIV of FIG. 12.

FIG. 11 is a perspective view of a ready-to-assemble toilet according to the second embodiment of the present invention. FIG. 12 is a plan view of the ready-to-assemble toilet shown in FIG. 11. FIG. 13 and FIG. 14 are cross-section views taken along the line XIII-XIII and the line XIV-XIV of FIG. 12, respectively. The ready-to-assemble toilet 2 is a box-shaped ready-to-assemble toilet made of corrugated board or cardboard. The ready-to-assemble toilet 2 has a rectangular parallelepiped shape including a sidewall portion 60 (first sidewall portion), a sidewall portion 70 (second sidewall portion), a sidewall portion 80 (third sidewall portion), a sidewall portion 90 (fourth sidewall portion), and the bottom portion 50. The ready-to-assemble toilet 2 is the same size as the ready-to-assemble toilet 1.

The sidewall portion 60 includes an outer sidewall 61, an inner sidewall 62, and a horizontal wall 63. The outer sidewall 61, the inner sidewall 62 and the horizontal wall 63 each have a rectangular shape. The inner sidewall 62 faces the outer sidewall 61. To be specific, the outer sidewall 61 and the inner sidewall 62 are each perpendicular to the bottom portion 50, and parallel to each other. In the present embodiment, the inner sidewall 62 is smaller than the outer sidewall 61. To be specific, the horizontal length of the inner sidewall 62 is substantially equal to the horizontal length of the outer sidewall 61, but the vertical length of the inner sidewall 62 is smaller than the vertical length of the outer sidewall 61. Therefore, the lower end of the inner sidewall 62 is spaced apart from the bottom portion 50 as shown in FIG. 13. The horizontal wall 63 connects the upper end of the outer sidewall 61 and the upper end of the inner sidewall 62. The sidewall portion 60 further includes an auxiliary piece 65 that extends from the lower end of the inner sidewall 62 to the bottom portion 50. The auxiliary piece 65 is provided separately from the inner sidewall 62.

The sidewall portion 70 includes an outer sidewall 71, an inner sidewall 72, and a horizontal wall 73. The outer sidewall 71, the inner sidewall 72 and the horizontal wall 73 each have a rectangular shape. The inner sidewall 72 faces the outer sidewall 71. To be specific, the outer sidewall 71 and the inner sidewall 72 are each perpendicular to the bottom portion 50, and parallel to each other. In the present embodiment, the outer sidewall 71 and the inner sidewall 72 have a substantially equal shape and size. That is, the horizontal length of the outer sidewall 71 is substantially equal to the horizontal length of the inner sidewall 72, and the vertical length of the outer sidewall 71 is substantially equal to the vertical length of the inner sidewall 72. Accordingly, the inner sidewall 72 faces the entirety of the outer sidewall 71. The lower end of the inner sidewall 72 reaches the bottom portion 50 as shown in FIG. 14. The horizontal wall 73 connects the upper end of the outer sidewall 71 and the upper end of the inner sidewall 72.

The sidewall portion 80 includes an outer sidewall 81, an inner sidewall 82, and a horizontal wall 83. The outer sidewall 81, the inner sidewall 82 and the horizontal wall 83 each have a rectangular shape. The inner sidewall 82 faces the outer sidewall 81. To be specific, the outer sidewall 81 and the inner sidewall 82 are each perpendicular to the bottom portion 50, and parallel to each other. In the present embodiment, the inner sidewall 82 is smaller than the outer sidewall 81. To be specific, the horizontal length of the inner sidewall 82 is substantially equal to the horizontal length of the outer sidewall 81, but the vertical length of the inner sidewall 82 is smaller than the vertical length of the outer sidewall 81. Therefore, the lower end of the inner sidewall 82 is spaced apart from the bottom portion 50 as shown in FIG. 13. The horizontal wall 83 connects the upper end of the outer sidewall 81 and the upper end of the inner sidewall 82. The sidewall portion 80 further includes an auxiliary piece 85 that extends from the lower end of the inner sidewall 82 to the bottom portion 50. The auxiliary piece 85 is provided separately from the inner sidewall 82.

The sidewall portion 90 includes an outer sidewall 91, an inner sidewall 92, and a horizontal wall 93. The outer sidewall 91, the inner sidewall 92 and the horizontal wall 93 each have a rectangular shape. The inner sidewall 92 faces the outer sidewall 91. To be specific, the outer sidewall 91 and the inner sidewall 92 are each perpendicular to the bottom portion 50, and parallel to each other. In the present embodiment, the outer sidewall 91 and the inner sidewall 92 have a substantially equal shape and size. That is, the horizontal length of the outer sidewall 91 is substantially equal to the horizontal length of the inner sidewall 92, and the vertical length of the outer sidewall 91 is substantially equal to the vertical length of the inner sidewall 92. Accordingly, the inner sidewall 92 faces the entirety of the outer sidewall 91. The lower end of the inner sidewall 92 reaches the bottom portion 50 as shown in FIG. 14. The horizontal wall 93 connects the upper end of the outer sidewall 91 and the upper end of the inner sidewall 92.

The horizontal wall 63 of the sidewall portion 60 and the horizontal wall 73 of the sidewall portion 70 overlap each other as shown in FIG. 11 and FIG. 12. To be specific, one end part of the horizontal wall 63 of the sidewall portion 60 overlies one end part of the horizontal wall 73 of the sidewall portion 70. The horizontal wall 73 of the sidewall portion 70 and the horizontal wall 83 of the sidewall portion 80 overlap each other. To be specific, one end part of the horizontal wall 83 of the sidewall portion 80 overlies the other end part of the horizontal wall 73 of the sidewall portion 70. The horizontal wall 83 of the sidewall portion 80 and the horizontal wall 93 of the sidewall portion 90 overlap each other. To be specific, the other end part of the horizontal wall 83 of the sidewall portion 80 overlies one end part of the horizontal wall 93 of the sidewall portion 90. The horizontal wall 93 of the sidewall portion 90 and the horizontal wall 63 of the sidewall portion 60 overlap each other. To be specific, the other end part of the horizontal wall 63 of the sidewall portion 60 overlies the other end part of the horizontal wall 93 of the sidewall portion 90.

In the ready-to-assemble toilet 2, the horizontal walls 63, 73, 83 and 93 of the sidewall portions 60, 70, 80 and 90 together function as a toilet seat. A space S2 surrounded by the sidewall portions 60, 70, 80 and 90 is used to collect excrement. Before the ready-to-assemble toilet 2 is used, a bag (not shown) for accommodating excrement is provided in the space S2 as described in connection with the ready-to-assemble toilet 1.

Figure 15:
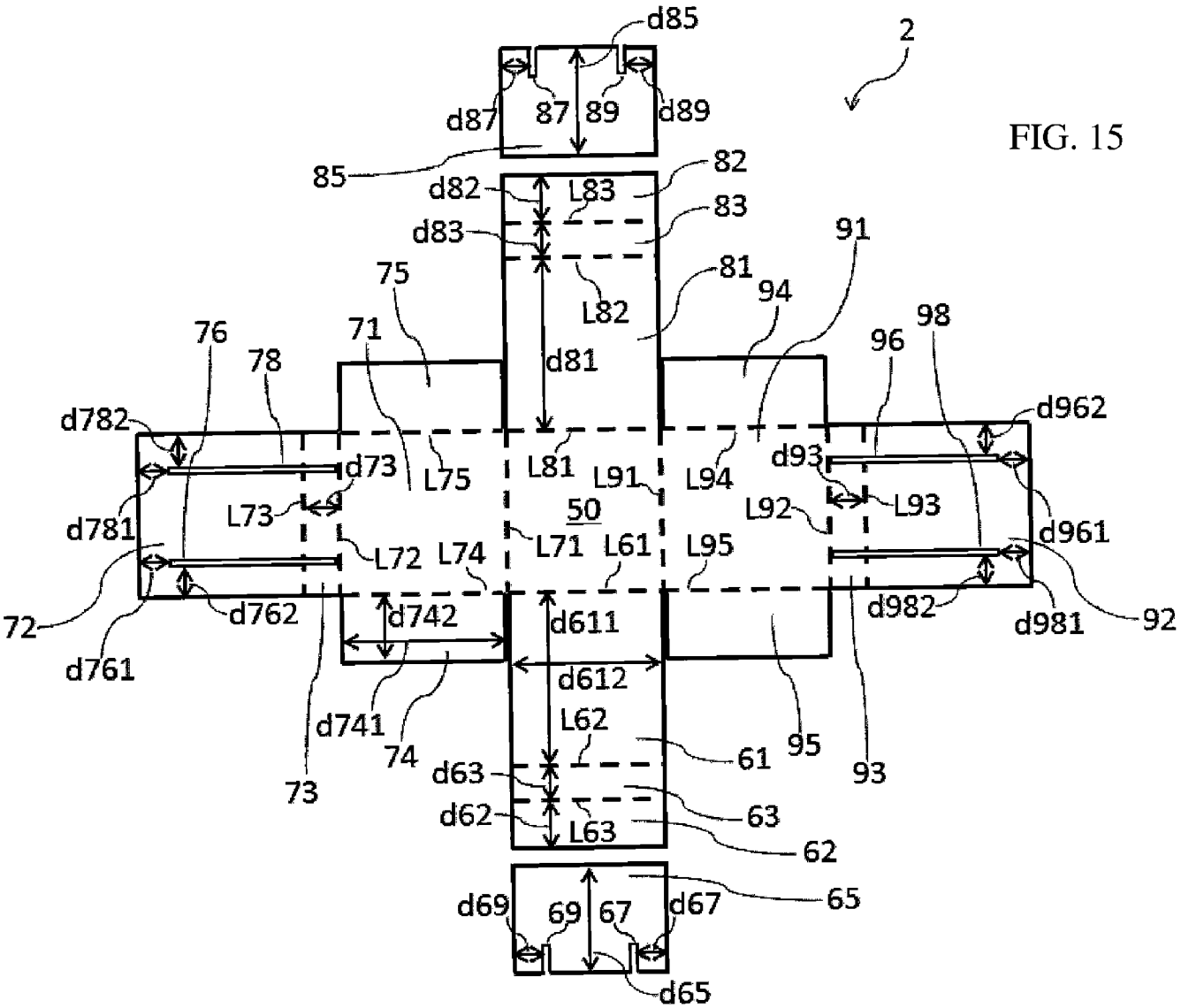
FIG. 15 is a plan view of the ready-to-assemble toilet shown in FIG. 11 before being assembled.

FIG. 15 is a plan view of the ready-to-assemble toilet 2 before being assembled. This diagram shows the internal side of the ready-to-assemble toilet 2. The ready-to-assemble toilet 2 is formed of a single sheet of flat corrugated board or cardboard except for the auxiliary pieces 65 and 85.

The outer sidewall 61 of the sidewall portion 60 is connected to one side (the bottom side in FIG. 15) of the bottom portion 50. In the sidewall portion 60, the horizontal wall 63 is connected to the outer sidewall 61, and the inner sidewall 62 is connected to the horizontal wall 63. A folding line L61 is formed at the boundary between the bottom portion 50 and the outer sidewall 61. A folding line L62 is formed at the boundary between the outer sidewall 61 and the horizontal wall 63. A folding line L63 is formed at the boundary between the horizontal wall 63 and the inner sidewall 62.

The auxiliary piece 65 is provided separately from the outer sidewall 61, the inner sidewall 62 and the horizontal wall 63. The sum of the vertical length d65 of the auxiliary piece 65 and the vertical length d62 of the inner sidewall 62 is substantially equal to the vertical length d611 of the outer sidewall 61. The horizontal length of the auxiliary piece 65 is substantially equal to the horizontal length of the inner sidewall 62.

A cut 67 and a cut 69 are formed in the auxiliary piece 65. The cuts 67 and 69 each extend from the lower end of the auxiliary piece 65 to a middle of the auxiliary piece 65. The distance d67 between the cut 67 and one side end of the auxiliary piece 65 is substantially equal to the width d93 of the horizontal wall 93 of the sidewall portion 90. The distance d69 between the cut 69 and the other side end of the auxiliary piece 65 is substantially equal to the width d73 of the horizontal wall 73 of the sidewall portion 70.

The outer sidewall 71 of the sidewall portion 70 is connected to another side (the left side in FIG. 15) of the bottom portion 50. In the sidewall portion 70, the horizontal wall 73 is connected to the outer sidewall 71, and the inner sidewall 72 is connected to the horizontal wall 73. A folding line L71 is formed at the boundary between the bottom portion 50 and the outer sidewall 71. A folding line L72 is formed at the boundary between the outer sidewall 71 and the horizontal wall 73. A folding line L73 is formed at the boundary between the horizontal wall 73 and the inner sidewall 72.

A reinforcing wall 74 and a reinforcing wall 75 are connected respectively to opposite sides of the outer sidewall 71. The reinforcing wall 74 is provided so as to overlap the outer sidewall 61 of the sidewall portion 60 in the ready-to-assemble toilet 2 after being assembled. The vertical length d741 of the reinforcing wall 74 is substantially equal to the vertical length d611 of the outer sidewall 61. The horizontal length d742 of the reinforcing wall 74 is substantially equal to a half of the horizontal length d612 of the outer sidewall 61. A folding line L74 is formed at the boundary between the outer sidewall 71 and the reinforcing wall 74. The reinforcing wall 75 is provided so as to overlap the outer sidewall 81 of the sidewall portion 80 in the ready-to-assemble toilet 2 after being assembled. The reinforcing wall 75 is substantially the same size as the reinforcing wall 74. A folding line L75 is formed at the boundary between the outer sidewall 71 and the reinforcing wall 75.

A slit 76 (first slit) and a slit 78 (second slit) are formed from the horizontal wall 73 to the inner sidewall 72. In the present embodiment, the slits 76 and 78 are each formed from the horizontal wall 73 to a middle of the inner sidewall 72. That is, the slits 76 and 78 each extend from the folding line L72 to the middle of the inner sidewall 72. The auxiliary piece 65 and the inner sidewall 62 are inserted into the slit 76. To be specific, the parts of the auxiliary piece 65 and the inner sidewall 62 which are on the extension line of the cut 69 (see FIG. 15) are inserted into the slit 76. At this time, the cut 69 is engaged with the part of the inner sidewall 72 where the slit 76 is not formed (the part on the extension line of the slit 76). The distance d761 between the slit 76 and the lower end of the inner sidewall 72 is substantially equal to the length of the cut 69. The distance d762 between the slit 76 and one side end of the inner sidewall 72 is substantially equal to the width d63 of the horizontal wall 63 of the sidewall portion 60. The auxiliary piece 85 and the inner sidewall 82 are inserted into the slit 78 as described later. The distance d782 between the slit 78 and the other side end of the inner sidewall 72 is substantially equal to the width d83 of the horizontal wall 83 of the sidewall portion 80.

The outer sidewall 81 of the sidewall portion 80 is connected to another side (the top side in FIG. 15) of the bottom portion 50. In the sidewall portion 80, the horizontal wall 83 is connected to the outer sidewall 81, and the inner sidewall 82 is connected to the horizontal wall 83. A folding line L81 is formed at the boundary between the bottom portion 50 and the outer sidewall 81. A folding line L82 is formed at the boundary between the outer sidewall 81 and the horizontal wall 83. A folding line L83 is formed at the boundary between the horizontal wall 83 and the inner sidewall 82.

The auxiliary piece 85 is provided separately from the outer sidewall 81, the inner sidewall 82 and the horizontal wall 83. The sum of the vertical length d85 of the auxiliary piece 85 and the vertical length d82 of the inner sidewall 82 is substantially equal to the vertical length d81 of the outer sidewall 81. The horizontal length of the auxiliary piece 85 is substantially equal to the horizontal length of the inner sidewall 82.

A cut 87 and a cut 89 are formed in the auxiliary piece 85. The cuts 87 and 89 each extend from the lower end of the auxiliary piece 85 to a middle of the auxiliary piece 85. The auxiliary piece 85 and the inner sidewall 82 are inserted into the slit 78 described above. To be specific, the parts of the auxiliary piece 85 and the inner sidewall 82 which are on the extension line of the cut 87 (see FIG. 15) are inserted into the slit 78. At this time, the cut 87 is engaged with the part of the inner sidewall 72 where the slit 78 is not formed (the part on the extension line of the slit 78). The length of the cut 87 is substantially equal to the distance d781 between the slit 78 and the lower end of the inner sidewall 72. The distance d87 between the cut 87 and one side end of the auxiliary piece 85 is substantially equal to the width d73 of the horizontal wall 73 of the sidewall portion 70. The distance d89 between the cut 89 and the other side end of the auxiliary piece 85 is substantially equal to the width d93 of the horizontal wall 93 of the sidewall portion 90.

The outer sidewall 91 of the sidewall portion 90 is connected to the other side (the right side in FIG. 15) of the bottom portion 50. In the sidewall portion 90, the horizontal wall 93 is connected to the outer sidewall 91, and the inner sidewall 92 is connected to the horizontal wall 93. A folding line L91 is formed at the boundary between the bottom portion 50 and the outer sidewall 91. A folding line L92 is formed at the boundary between the outer sidewall 91 and the horizontal wall 93. A folding line L93 is formed at the boundary between the horizontal wall 93 and the inner sidewall 92.

A reinforcing wall 94 and a reinforcing wall 95 are connected respectively to opposite sides of the outer sidewall 91. The reinforcing wall 94 is provided so as to overlap the outer sidewall 81 of the sidewall portion 80 in the ready-to-assemble toilet 2 after being assembled. A folding line L94 is formed at the boundary between the outer sidewall 91 and the reinforcing wall 94. The reinforcing wall 95 is provided so as to overlap the outer sidewall 61 of the sidewall portion 60 in the ready-to-assemble toilet 2 after being assembled. A folding line L95 is formed at the boundary between the outer sidewall 91 and the reinforcing wall 95. Each of the reinforcing walls 94 and 95 is substantially the same size as the reinforcing wall 74.

A slit 96 (third slit) and a slit 98 (fourth slit) are formed from the horizontal wall 93 to the inner sidewall 92. In the present embodiment, the slits 96 and 98 are each formed from the horizontal wall 93 to a middle of the inner sidewall 92. That is, the slits 96 and 98 each extend from the folding line L92 to the middle of the inner sidewall 92. The auxiliary piece 85 and the inner sidewall 82 are inserted into the slit 96. To be specific, the parts of the auxiliary piece 85 and the inner sidewall 82 which are on the extension line of the cut 89 (see FIG. 15) are inserted into the slit 96. At this time, the cut 89 is engaged with the part of the inner sidewall 92 where the slit 96 is not formed (the part on the extension line of the slit 96). The distance d961 between the slit 96 and the lower end of the inner sidewall 92 is substantially equal to the length of the cut 89. The distance d962 between the slit 96 and one side end of the inner sidewall 92 is substantially equal to the width d83 of the horizontal wall 83 of the sidewall portion 80.

The auxiliary piece 65 and the inner sidewall 62 are inserted into the slit 98. To be specific, the parts of the auxiliary piece 65 and the inner sidewall 62 which are on the extension line of the cut 67 (see FIG. 15) are inserted into the slit 98. At this time, the cut 67 is engaged with the part of the inner sidewall 92 where the slit 98 is not formed (the part on the extension line of the slit 98). The distance d981 between the slit 98 and the lower end of the inner sidewall 92 is substantially equal to the length of the cut 67. The distance d982 between the slit 98 and the other side end of the inner sidewall 92 is substantially equal to the width d63 of the horizontal wall 63 of the sidewall portion 60.

Figure 16:
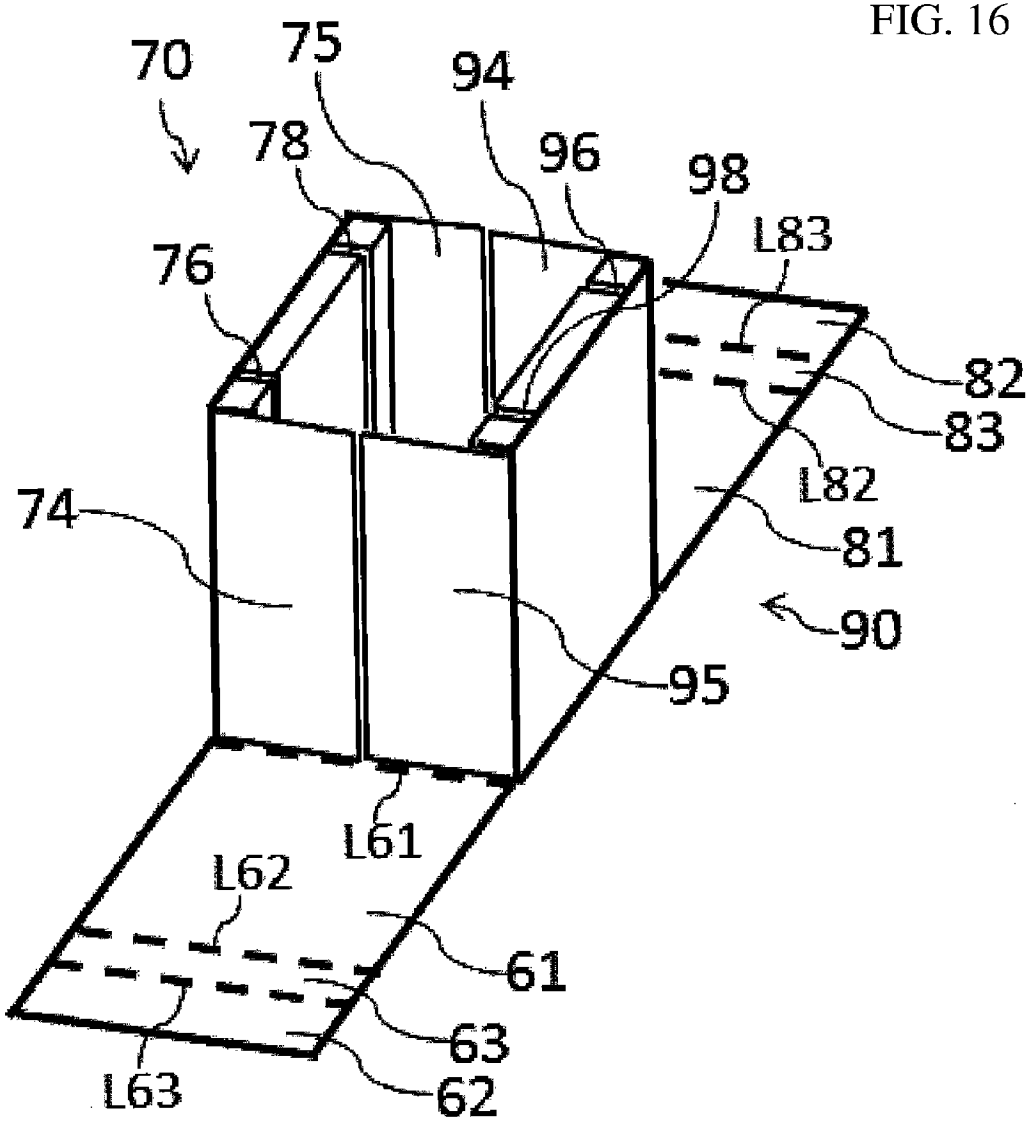
FIG. 16 is a diagram illustrating an assembly procedure of the ready-to-assemble toilet shown in FIG. 11.

An assembly procedure of the ready-to-assemble toilet 2 will be described with reference to FIG. 16 and FIG. 17. First, the sidewall portion 70 is assembled by folding along the folding lines L71 to L75. To be specific, the sidewall portion 70 standing upright on the bottom portion 50 is obtained by folding along the folding lines L71 to L75 to form valley folds having a substantially right angle as shown in FIG. 16. Likewise, the sidewall portion 90 is assembled by folding along the folding lines L91 to L95. To be specific, the sidewall portion 90 standing upright on the bottom portion 50 is obtained by folding along the folding lines L91 to L95 to form valley folds having a substantially right angle as shown in FIG. 16. Assembly of the sidewall portion 90 may be performed prior to assembly of the sidewall portion 70 or concurrently with assembly of the sidewall portion 70.

Figure 17:
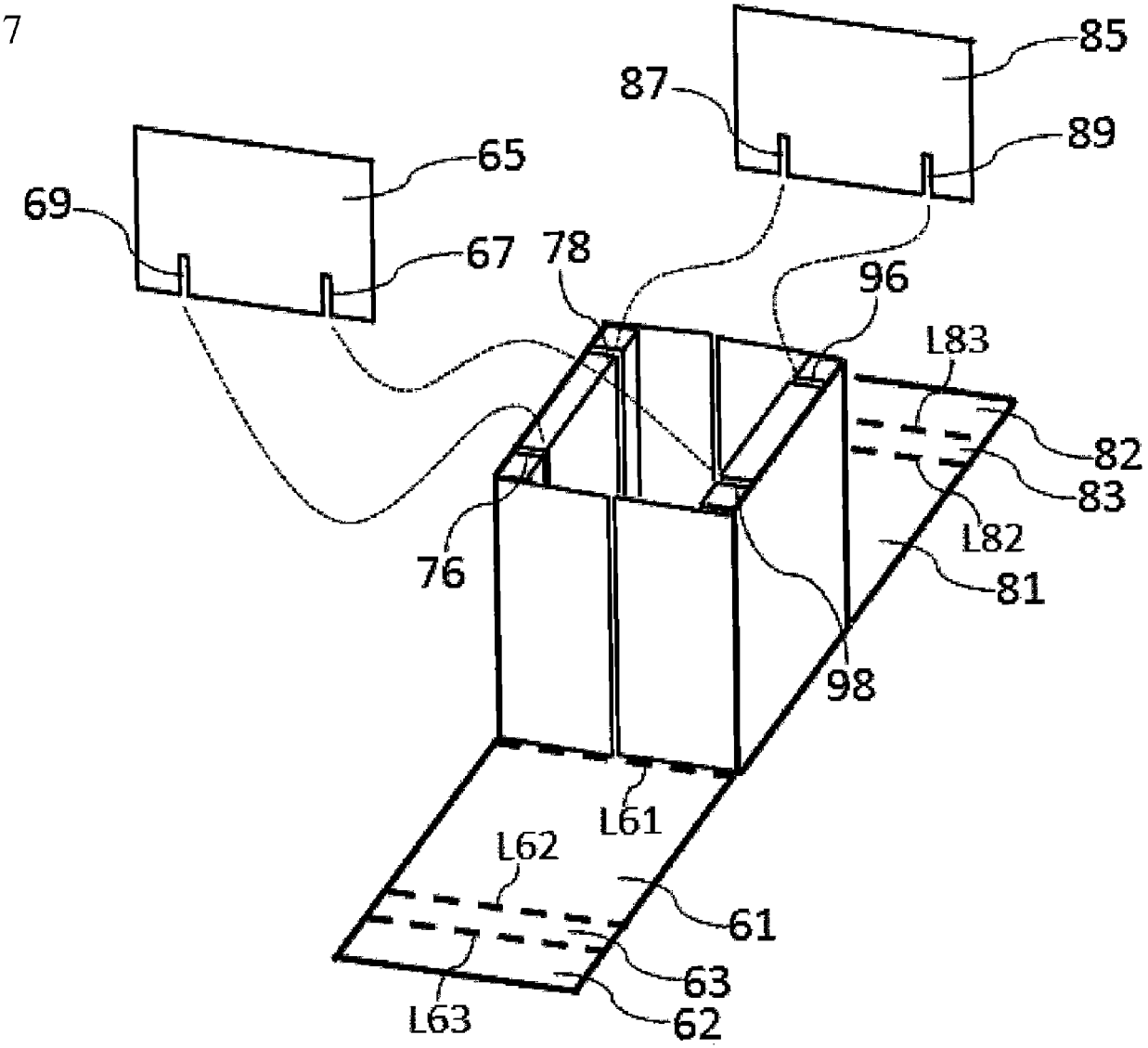
FIG. 17 is a diagram illustrating the assembly procedure of the ready-to-assemble toilet shown in FIG. 11.

Next, the auxiliary piece 65 is inserted into the slits 76 and 98 as shown in FIG. 17. To be specific, the auxiliary piece 65 is inserted such that the cut 69 is engaged with the part of the inner sidewall 72 which is on the extension line of the slit 76 and the cut 67 is engaged with the part of the inner sidewall 92 which is on the extension line of the slit 98. Likewise, the auxiliary piece 85 is inserted into the slits 78 and 96. To be specific, the auxiliary piece 85 is inserted such that the cut 87 is engaged with the part of the inner sidewall 72 which is on the extension line of the slit 78 and the cut 89 is engaged with the part of the inner sidewall 92 which is on the extension line of the slit 96. Insertion of the auxiliary piece 85 may be performed prior to insertion of the auxiliary piece 65 or concurrently with insertion of the auxiliary piece 65.

Next, the sidewall portion 60 is assembled by folding along the folding lines L61 to L63. To be specific, the sidewall portion 60 standing upright on the bottom portion 50 is obtained by folding along the folding lines L61 to L63 to form valley folds having a substantially right angle as shown in FIG. 11. At this time, the inner sidewall 62 is inserted into the slits 76 and 98. Also, the outer sidewall 61 is overlapped by the reinforcing walls 74 and 95. To be specific, substantially the entirety of the internal surface of the outer sidewall 61 is covered by the reinforcing walls 74 and 95. The outer sidewall 61 may be bonded to each of the reinforcing walls 74 and 95.

Likewise, the sidewall portion 80 is assembled by folding along the folding lines L81 to L83. To be specific, the sidewall portion 80 standing upright on the bottom portion 50 is obtained by folding along the folding lines L81 to L83 to form valley folds having a substantially right angle as shown in FIG. 11. At this time, the inner sidewall 82 is inserted into the slits 78 and 96. Also, the outer sidewall 81 is overlapped by the reinforcing walls 75 and 94. To be specific, substantially the entirety of the internal surface of the outer sidewall 81 is covered by the reinforcing walls 75 and 94. The outer sidewall 81 may be bonded to each of the reinforcing walls 75 and 94. Assembly of the sidewall portion 80 may be performed prior to assembly of the sidewall portion 60 or concurrently with assembly of the sidewall portion 60. Accordingly, the ready-to-assemble toilet 2 shown in FIG. 11 is obtained.

Advantageous effects of the ready-to-assemble toilet 2 will be described. In the ready-to-assemble toilet 2, each of the sidewall portions 60, 70, 80 and 90 has a double-wall structure formed of the outer sidewalls 61, 71, 81 and 91, and the inner sidewalls 62, 72, 82 and 92. Furthermore, each of the sidewall portions 60, 70, 80 and 90 is provided with the horizontal walls 63, 73, 83 and 93 that connect the outer sidewalls 61, 71, 81 and 91, and the inner sidewalls 62, 72, 82 and 92. The horizontal walls 63, 73, 83 and 93 of the sidewall portions 60, 70, 80 and 90 each overlap the horizontal walls 63, 73, 83 and 93 of the adjacent sidewall portions 60, 70, 80 and 90. Accordingly, a structure where the sidewall portions 60, 70, 80 and 90 support each other is implemented, and therefore the strength of the ready-to-assemble toilet 2 can be remarkably enhanced.

The slits 76 and 98 are formed in the sidewall portions 70 and 90, respectively. By inserting the inner sidewall 62 of the sidewall portion 60 into the slits 76 and 98, the horizontal wall 63 of the sidewall portion 60 overlies the horizontal wall 73 of the sidewall portion 70 and the horizontal wall 93 of the sidewall portion 90. Thus, fixing the sidewall portions 60 and 70 to each other and fixing the sidewall portions 60 and 90 to each other can be performed by one action (the action of inserting the inner sidewall 62 into the slits 76 and 98).

The slits 78 and 96 are formed in the sidewall portions 70 and 90, respectively. By inserting the inner sidewall 82 of the sidewall portion 80 into the slits 78 and 96, the horizontal wall 83 of the sidewall portion 80 overlies the horizontal wall 73 of the sidewall portion 70 and the horizontal wall 93 of the sidewall portion 90. Thus, fixing the sidewall portions 80 and 70 to each other and fixing the sidewall portions 80 and 90 to each other can be performed by one action (the action of inserting the inner sidewall 82 into the slits 78 and 96).

The vertical length of the inner sidewall 62 is smaller than the vertical length of the outer sidewall 61. Thus, insertion of the inner sidewall 62 into the slits 76 and 98 can be easily performed.

The sidewall portion 60 is provided with the auxiliary piece 65 extending from the lower end of the inner sidewall 62 to the bottom portion 50. That is, the auxiliary piece 65 is disposed so as to face the lower part (the part which is not faced by the inner sidewall 62) of the outer sidewall 61. Accordingly, despite that the vertical length of the inner sidewall 62 is small, the double-wall structure is maintained throughout the height direction of the sidewall portion 60.

The vertical length of the inner sidewall 82 is smaller than the vertical length of the outer sidewall 81. Thus, insertion of the inner sidewall 82 into the slits 78 and 96 can be easily performed.

The sidewall portion 80 is provided with the auxiliary piece 85 extending from the lower end of the inner sidewall 82 to the bottom portion 50. That is, the auxiliary piece 85 is disposed so as to face the lower part (the part which is not faced by the inner sidewall 82) of the outer sidewall 81. Accordingly, despite that the vertical length of the inner sidewall 82 is small, the double-wall structure is maintained throughout the height direction of the sidewall portion 80.

Substantially the entirety of the outer sidewall 61 is covered by the reinforcing walls 74 and 95. Accordingly, it is possible to further enhance the strength of the sidewall portion 60 and eventually the strength of the ready-to-assemble toilet 2. Likewise, substantially the entirety of the outer sidewall 81 is covered by the reinforcing walls 75 and 94. Accordingly, it is possible to further enhance the strength of the sidewall portion 80 and eventually the strength of the ready-to-assemble toilet 2. The other advantageous effects of the ready-to-assemble toilet 2 are the same as described in connection with the ready-to-assemble toilet 1.

The ready-to-assemble toilet according to the present invention is not limited to the above embodiments, and it is possible to make various modifications. The embodiment given above illustrated an example in which the ready-to-assemble toilet is formed of a single sheet of corrugated board or cardboard. However, the ready-to-assemble toilet may be formed of a plurality of sheets of corrugated board or cardboard. In this case, the plurality of sheets of corrugated board or cardboard are connected to each other by an appropriate means (for example, by bonding them together with gummed tape).

Figure 18:
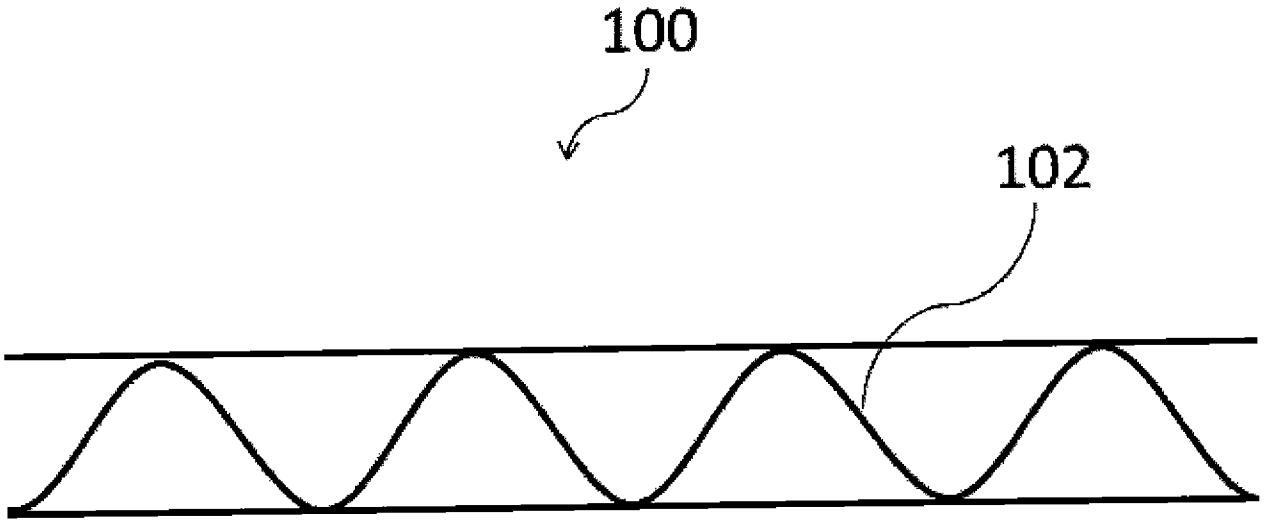
FIG. 18 is a diagram illustrating a structure of corrugated board.

In the case where the ready-to-assemble toilet is formed of a plurality of sheets of corrugated board, it is preferable that the direction of corrugations of the inner core of the first to fourth sidewall portions is parallel to the height direction of the first to fourth sidewall portions. That is, as shown in a side view in FIG. 18, corrugated board 100 has a corrugated inner core 102, and the direction of corrugations of the inner core 102 (the direction perpendicular to the plane of paper) is preferably parallel to the height direction of the sidewall portions. This configuration advantageously serves to enhance the strength of the ready-to-assemble toilet. That is, a user is seated on the ready-to-assemble toilet while in use, and thus the ready-to-assemble toilet mostly receives a heightwise (vertical) force. Because corrugated board is tough particularly against the force in the direction of corrugations of inner core thereof, by aligning the direction of corrugations with the height direction, the strength of the ready-to-assemble toilet against the heightwise force can be enhanced.

Figure 19:
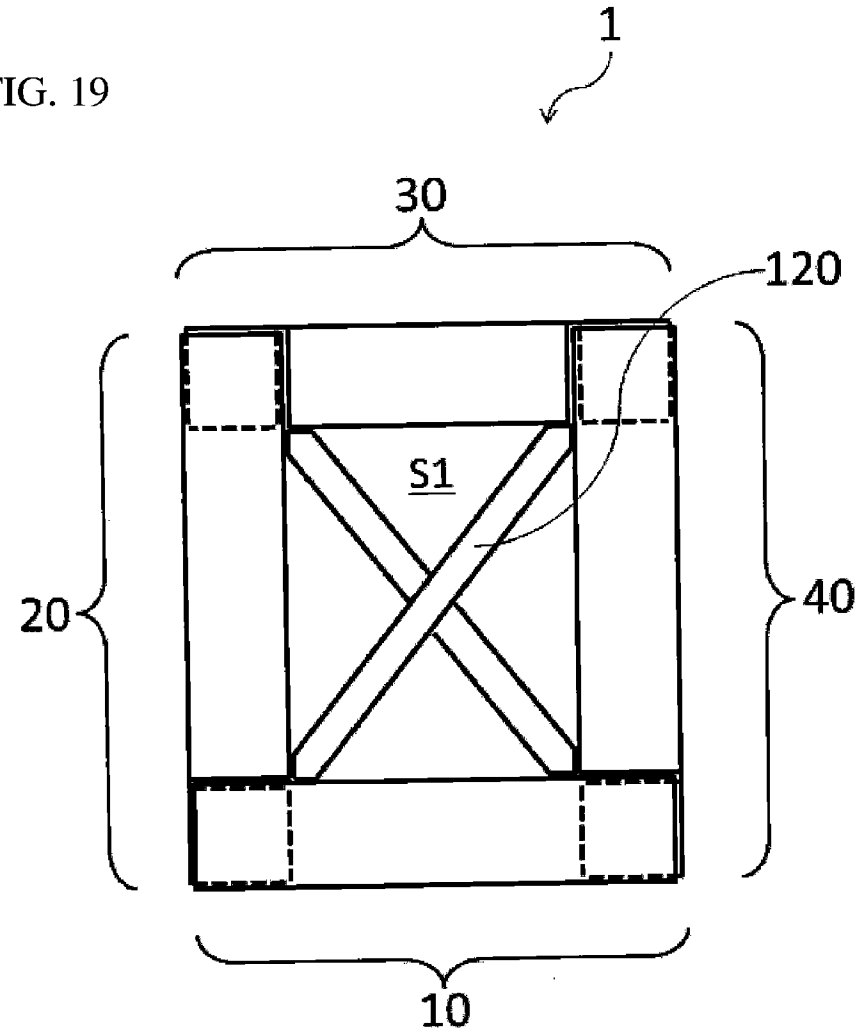
FIG. 19 is a plan view of a ready-to-assemble toilet according to a variation.

In the embodiments given above, a spacer 120 may be provided as shown in FIG. 19. This diagram shows an example in which the spacer 120 is provided to the ready-to-assemble toilet 1 shown in FIG. 2. In this example, two spacers 120 are provided. The spacers 120 are disposed in the space S1 surrounded by the sidewall portions 10, 20, 30 and 40. The spacers 120 have rigidity, and are in contact with the inner sidewalls of at least two sidewall portions of the sidewall portions 10, 20, 30 and 40. In this example, the spacers 120 are each in contact with the inner sidewalls of all the sidewall portions 10, 20, 30 and 40. For example, a plastic bar-shaped member can be used as the spacer 120. By providing the spacer 120, the sidewall portions 10, 20, 30 and 40 can be restrained from inclining inward. Also, even when the bag disposed in the space S1 is shallow, the bag can be prevented from dropping on the bottom portion 50.

Figure 20:
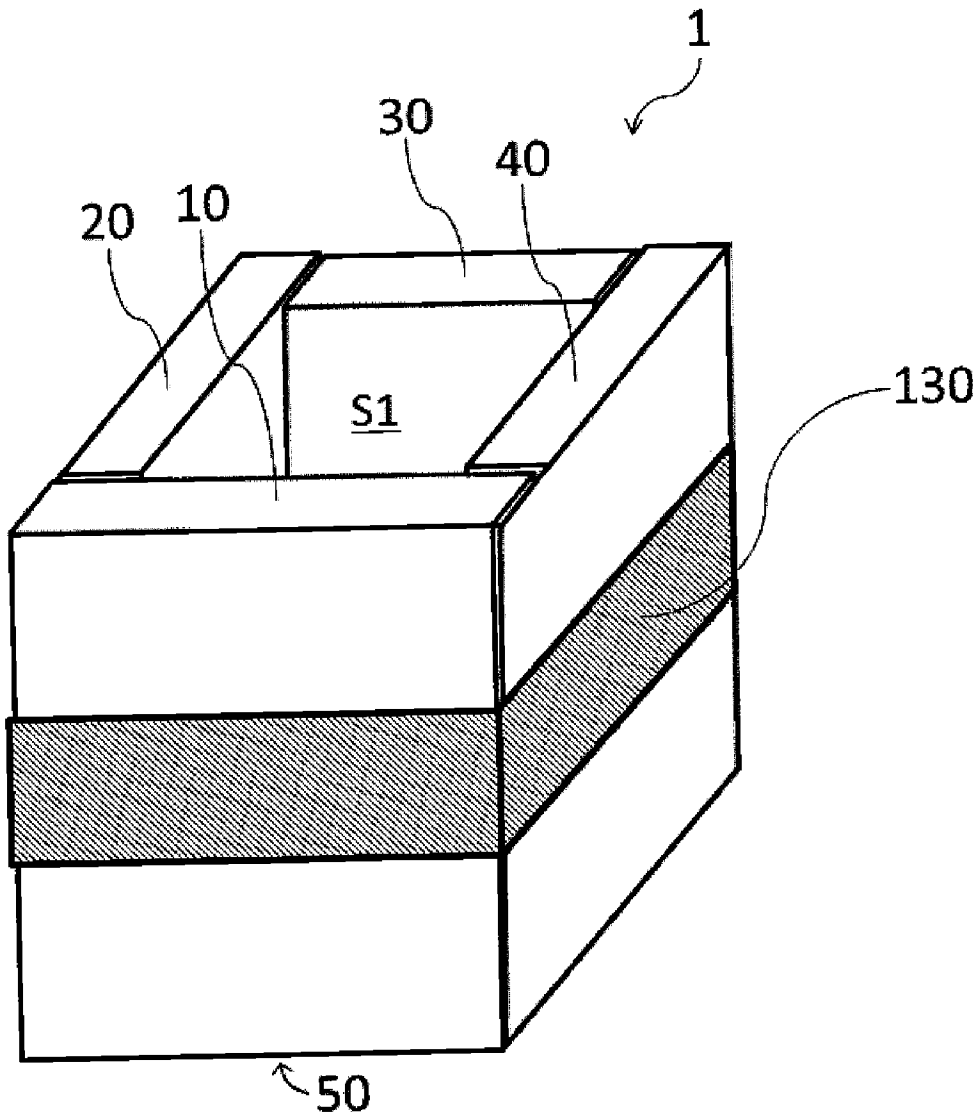
FIG. 20 is a perspective view of a ready-to-assemble toilet according to another variation.

In the embodiments given above, a fixing member 130 may be provided as shown in FIG. 20. This diagram shows an example in which the fixing member 130 is provided to the ready-to-assemble toilet 1 shown in FIG. 1. The fixing member 130 is provided around the sidewall portions 10, 20, 30 and 40. To be specific, the fixing member 130 is provided so as to surround the sidewall portions 10, 20, 30 and 40. The fixing member 130 fastens the sidewall portions 10, 20, 30 and 40. For example, a band-shaped member made of rubber or surface fastener can be used as the fixing member 130. By providing the fixing member 130, the sidewall portions 10, 20, 30 and 40 can be restrained from inclining outward. Also, even when the bag disposed in the space S1 is damaged, excrement is unlikely to leak to the outside of the ready-to-assemble toilet 1.

What is claimed is:

1. A ready-to-assemble toilet made of corrugated board or cardboard and being box-shaped, comprising:

a first sidewall portion, a second sidewall portion adjacent to the first sidewall portion, a third sidewall portion adjacent to the second sidewall portion, a fourth sidewall portion adjacent to the third sidewall portion, and a bottom portion, wherein each of the first to fourth sidewall portions includes an outer sidewall, an inner sidewall facing the outer sidewall, and a horizontal wall connecting an upper end of the outer sidewall and an upper end of the inner sidewall, the horizontal wall of the first sidewall portion and the horizontal wall of the second sidewall portion overlap each other, the horizontal wall of the second sidewall portion and the horizontal wall of the third sidewall portion overlap each other, the horizontal wall of the third sidewall portion and the horizontal wall of the fourth sidewall portion overlap each other, the horizontal wall of the fourth sidewall portion and the horizontal wall of the first sidewall portion overlap each other, one sidewall portion of the first and second sidewall portions has a first slit formed from the horizontal wall to the inner sidewall, and the horizontal wall of the other sidewall portion of the first and second sidewall portions overlies the horizontal wall of the one sidewall portion of the first and second sidewall portions by inserting the inner sidewall of the other sidewall portion of the first and second sidewall portions into the first slit.

2. The ready-to-assemble toilet according to claim 1, wherein the first slit is formed from the horizontal wall to a middle of the inner sidewall in the one sidewall portion of the first and second sidewall portions, the inner sidewall of the other sidewall portion of the first and second sidewall portions has a first cut extending from a lower end of the inner sidewall, and the first cut is engaged with a part of the inner sidewall of the one sidewall portion of the first and second sidewall portions, the part being on an extension line of the first slit.

3. The ready-to-assemble toilet according to claim 1, wherein one sidewall portion of the second and third sidewall portions has a second slit formed from the horizontal wall to the inner sidewall, and the horizontal wall of the other sidewall portion of the second and third sidewall portions overlies the horizontal wall of the one sidewall portion of the second and third sidewall portions by inserting the inner sidewall of the other sidewall portion of the second and third sidewall portions into the second slit.

4. The ready-to-assemble toilet according to claim 3, wherein the second slit is formed from the horizontal wall to a middle of the inner sidewall in the one sidewall portion of the second and third sidewall portions, the inner sidewall of the other sidewall portion of the second and third sidewall portions has a second cut extending from a lower end of the inner sidewall, and the second cut is engaged with a part of the inner sidewall of the one sidewall portion of the second and third sidewall portions, the part being on an extension line of the second slit.

5. The ready-to-assemble toilet according to claim 3, wherein one sidewall portion of the third and fourth sidewall portions has a third slit formed from the horizontal wall to the inner sidewall, and the horizontal wall of the other sidewall portion of the third and fourth sidewall portions overlies the horizontal wall of the one sidewall portion of the third and fourth sidewall portions by inserting the inner sidewall of the other sidewall portion of the third and fourth sidewall portions into the third slit.

6. The ready-to-assemble toilet according to claim 5, wherein the third slit is formed from the horizontal wall to a middle of the inner sidewall in the one sidewall portion of the third and fourth sidewall portions, the inner sidewall of the other sidewall portion of the third and fourth sidewall portions has a third cut extending from a lower end of the inner sidewall, and the third cut is engaged with a part of the inner sidewall of the one sidewall portion of the third and fourth sidewall portions, the part being on an extension line of the third slit.

7. The ready-to-assemble toilet according to claim 5, wherein one sidewall portion of the fourth and first sidewall portions has a fourth slit formed from the horizontal wall to the inner sidewall, and the horizontal wall of the other sidewall portion of the fourth and first sidewall portions overlies the horizontal wall of the one sidewall portion of the fourth and first sidewall portions by inserting the inner sidewall of the other sidewall portion of the fourth and first sidewall portions into the fourth slit.

8. The ready-to-assemble toilet according to claim 7, wherein the fourth slit is formed from the horizontal wall to a middle of the inner sidewall in the one sidewall portion of the fourth and first sidewall portions, the inner sidewall of the other sidewall portion of the fourth and first sidewall portions has a fourth cut extending from a lower end of the inner sidewall, and the fourth cut is engaged with a part of the inner sidewall of the one sidewall portion of the fourth and first sidewall portions, the part being on an extension line of the fourth slit.

9. The ready-to-assemble toilet according to claim 7, wherein the first slit is formed in the second sidewall portion, the fourth slit is formed in the fourth sidewall portion, and the horizontal wall of the first sidewall portion overlies the horizontal walls of the second and fourth sidewall portions by inserting the inner sidewall of the first sidewall portion into the first and fourth slits.

10. The ready-to-assemble toilet according to claim 9, wherein a vertical length of the inner sidewall of the first sidewall portion is smaller than a vertical length of the outer sidewall of the first sidewall portion.

11. The ready-to-assemble toilet according to claim 10, wherein the first sidewall portion includes an auxiliary piece extending from a lower end of the inner sidewall of the first sidewall portion to the bottom portion.

12. The ready-to-assemble toilet according to claim 9, wherein the second slit is formed in the second sidewall portion, the third slit is formed in the fourth sidewall portion, and the horizontal wall of the third sidewall portion overlies the horizontal walls of the second and fourth sidewall portions by inserting the inner sidewall of the third sidewall portion into the second and third slits.

13. The ready-to-assemble toilet according to claim 12, wherein a vertical length of the inner sidewall of the third sidewall portion is smaller than a vertical length of the outer sidewall of the third sidewall portion.

14. The ready-to-assemble toilet according to claim 13, wherein the third sidewall portion includes an auxiliary piece extending from a lower end of the inner sidewall of the third sidewall portion to the bottom portion.

15. The ready-to-assemble toilet according to claim 1, wherein the horizontal walls of the first to fourth sidewall portions function as a toilet seat.

16. The ready-to-assemble toilet according to claim 1, wherein each of the first to fourth sidewall portions is formed of a single sheet of corrugated board or cardboard having a plurality of folding lines, and is configured such that the outer sidewall, the inner sidewall and the horizontal wall are formed by folding along the folding lines.

17. The ready-to-assemble toilet according to claim 1, wherein the ready-to-assemble toilet is formed of a single sheet of flat corrugated board or cardboard.

18. The ready-to-assemble toilet according to claim 1, wherein the ready-to-assemble toilet is formed of a plurality of sheets of corrugated board having a corrugated inner core, and a direction of corrugations of the inner core of each of the first to fourth sidewall portions is parallel to a height direction of the sidewall portions.

19. The ready-to-assemble toilet according to claim 1, further comprising:

a spacer provided in a space surrounded by the first to fourth sidewall portions, and being in contact with the inner sidewalls of at least two sidewall portions of the first to fourth sidewall portions.

20. The ready-to-assemble toilet according to claim 1, further comprising:

a fixing member provided around the first to fourth sidewall portions, and fastening the first to fourth sidewall portions.

21. The ready-to-assemble toilet according to claim 1, wherein at least one sidewall portion of the first to fourth sidewall portions includes a reinforcing wall provided so as to overlap the outer sidewall.

22. The ready-to-assemble toilet according to claim 21, wherein in the at least one sidewall portion, substantially an entirety of the outer sidewall is covered by the reinforcing wall.

* * * * *